US008365473B2

(12) United States Patent
Bjerre

(10) Patent No.: US 8,365,473 B2
(45) Date of Patent: Feb. 5, 2013

(54) PREFABRICATED SELF-SUPPORTING CONSTRUCTION ELEMENT

(75) Inventor: Ole Bjerre, Aalborg SV (DK)

(73) Assignee: Build-Pod International Ltd., Guemsey (GB)

( * ) Notice: Subject to any disclaimer, the term of this patent is extended or adjusted under 35 U.S.C. 154(b) by 5 days.

(21) Appl. No.: 12/921,437

(22) PCT Filed: Mar. 13, 2009

(86) PCT No.: PCT/DK2009/050057

§ 371 (c)(1),
(2), (4) Date: Sep. 8, 2010

(87) PCT Pub. No.: WO2009/112037

PCT Pub. Date: Sep. 17, 2009

(65) Prior Publication Data

US 2011/0011011 A1 Jan. 20, 2011

(30) Foreign Application Priority Data

Mar. 14, 2008 (DK) ..... 2008 00394

(51) Int. Cl.
*E04H 1/00* (2006.01)

(52) U.S. Cl. ..... 52/79.9; 52/79.14; 52/236.3; 52/236.5; 52/405.2; 52/602

(58) Field of Classification Search ..... 52/79.1, 52/79.9, 79.13, 79.14, 79.11, 234, 235, 236.3, 52/236.4–236.9, 106, 405.1–405.3, 602
See application file for complete search history.

(56) References Cited

U.S. PATENT DOCUMENTS

| | | | | |
|---|---|---|---|---|
| 3,500,595 | A * | 3/1970 | Bennett | 52/79.13 |
| 3,990,193 | A * | 11/1976 | Ray et al. | 52/79.11 |
| 4,299,065 | A * | 11/1981 | Fairgrieve | 52/79.7 |
| 4,443,992 | A * | 4/1984 | Shechter | 52/745.02 |
| 6,871,453 | B2 * | 3/2005 | Locke | 52/79.13 |
| 7,594,361 | B2 * | 9/2009 | Tragant Ruano | 52/79.9 |
| 7,827,738 | B2 * | 11/2010 | Abrams et al. | 52/79.1 |
| 2006/0156642 | A1 * | 7/2006 | Terzi | 52/79.1 |
| 2007/0271857 | A1 * | 11/2007 | Heather et al. | 52/79.9 |

FOREIGN PATENT DOCUMENTS

WO WO-2009/061702 A1 5/2009

* cited by examiner

*Primary Examiner* — Brian Glessner
*Assistant Examiner* — Adam Barlow
(74) *Attorney, Agent, or Firm* — Barnes & Thornburg LLP

(57) ABSTRACT

For establishing a more modern and environmental, inexpensive building, there is disclosed a prefabricated, self-supporting construction element (6) intended chiefly for apartment buildings, where a number of construction elements (6) are placed at the side of one another and on top of one another, and comprising at least two substantially parallel-extending walls (26), where the external side surface (14) is profiled with protruding ribs (16) which, in combination with corresponding external side surfaces (14) of corresponding construction elements (6) along the external side surfaces (14), form a plurality of channels (60) respectively intended for in-situ casting with a (flowing), hardening material (concrete) for the formation of a supporting construction in the form of columns (94) and beams for supporting a plurality of construction elements (6) placed on top of one another, and for the leading of supply pipes and cables to the building, which is characteristic in that the external side surfaces (14) comprise insulating material (18) which, when placed together with corresponding side surfaces, form a stable element which constitutes a permanent insulating cladding (16, 18) for the supporting structure molded in-situ later.

19 Claims, 20 Drawing Sheets

Figure 1:
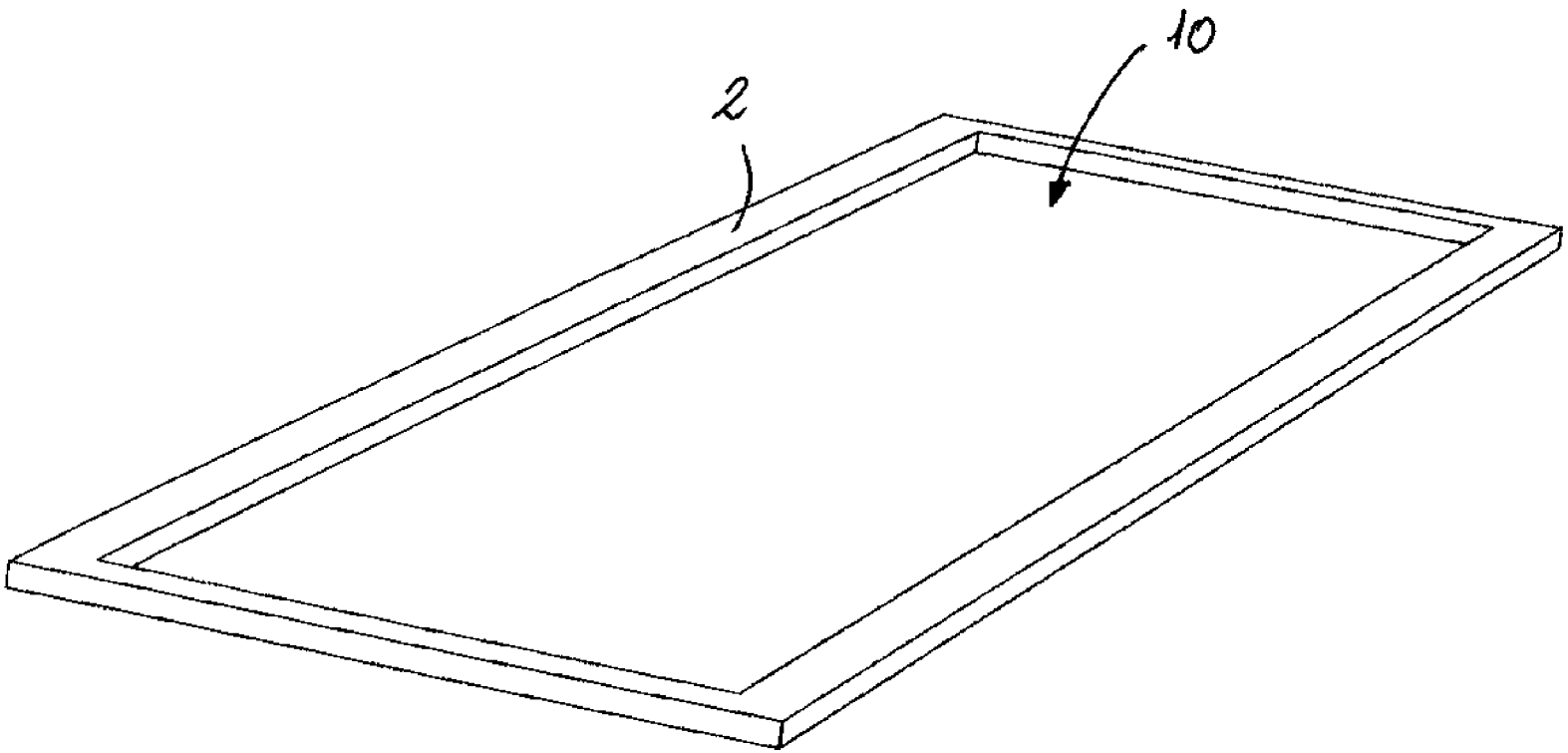

66
62.
78
69
68
40
76

66
62.
78
69
68
40
76

66
62.
78
69
68
40
76

70
72
74
66
62.
72'
74'
70'
69
68

74
66, 74
72
62
72'
69
68

PREFABRICATED SELF-SUPPORTING CONSTRUCTION ELEMENT

The present invention relates to a prefabricated self-supporting construction element intended chiefly for multi-storey buildings by placing a plurality of these at the side of one another and on top of one another, and comprising at least two substantially parallel-extending walls standing upright from a substantially rectangular floor side, and a ceiling side, with an inside side surface and an outside side surface, and where the inside side surface appears as a completely finished side surface and where the outer side is profiled with protruding ribs which, in combination with facing outer sides of corresponding construction elements along the outside wall sides, ceiling sides and floor side, form a plurality of horizontally-oriented and vertically-oriented cavities (channels) intended for in-situ casting with a (flowing), hardening material (concrete) for the formation of a supporting construction (columns and beams) for the support of a multiple of construction elements placed on top of each other, and for the leading of supply pipes and cables to the building.

Such constructions are known from, among other things, GB 1 262 521, in which there are disclosed self-supporting tubular construction elements with ribs for reinforcement of the supporting capacity. What are described are thus tubular construction elements which could actually stand by themselves and support themselves. To provide the stability and jointing between the respective elements, which are placed on top of each other, there is carried out a provisional casting of some of the cavities which are formed by the ribs when the construction elements are brought at the side of one another for the formation of vertically-oriented support columns and horizontally-oriented beams, for the provision of extra lateral stability. The disadvantage of said construction is that the construction elements, after the moulding, are difficult to remove from the mould, with the result that the individual tubular construction elements become relatively short, whereby a room division which is created with said construction elements will most often come to comprise several of the same with subsequent joints which must be processed afterwards in order to provide a nice finish internally. Moreover, the short construction elements will result in these coming to comprise a plurality of protruding ribs in order to make the elements torsionally stable, the consequence being that they become heavy and that the building consisting of said known construction elements will demand relatively powerful transport and lifting tackle. Moreover, said construction elements do not comprise gable sides, which means that a great deal of work will be required afterwards for the establishing of these at the building site after the elements have been erected.

FR 1 532 245 discloses a bell-shaped construction element without bottom, i.e. without floor, which is loose, and is laid out before the positioning of the bell-shaped construction element. The construction element comprises protruding ribs which, when a plurality of these are brought at the side of each other and on top of each other, will form channels for casting with the object of creating columns and beams for the stabilising of the building. Casting is carried out of only some of said cavities, not all, in that some are used for the leading of installations and pipes, and for aeration of the building construction itself. The construction element can also comprise sound-proofing. The disadvantage with said construction element is that the walls of the bell-shaped construction element must necessarily be sloping in order to provide the possibility of removing the elements after the moulding. Alternatively, use must be made of very costly moulding equipment, for example a telescopic mould or a mould with displaceable sides. All else being equal, this type of construction element will demand a subsequent processing of the inside surfaces of the construction element. Moreover, the construction element does not open possibilities for the casting of columns and beams at the outer sides of the building, which is inexpedient, inasmuch as the casting of columns at the outer sides provides the possibility for a considerable increase in the strength of the column, if this is desirable.

From U.S. Pat. No. 4,299,065 (FAIRGREVE) there is known a box-shaped cell of metal for building together with other similar cells which comprise side walls and ceiling. The walls have ribs on the outer side, and the ribs form cavities with the ribs of adjacent cells when they are built together. Concrete is poured in the space which arises between two cells. The concrete adheres firmly to these ribs and forms a supporting wall, which contributes to the support of further box-shaped cells which are placed on top of a relevant box-shaped cell. The construction is intended to function as a permanent cladding.

Said known constructions, however, have in common that these are relatively heavy, inasmuch as it is presupposed that a number of said prefabricated construction elements are placed on top of one another, after which the above-mentioned casting is carried out for up to several storeys at a time. Moreover, with the use of the known construction elements, it is presupposed that subsequent processing is effected on the inside walls (floors) after the construction elements have been placed on top of and at the side of one another, which means that there will continue to be a need for some degree of finishing operations after a number of the known construction elements, of which a building construction consists, will appear as fully finished internally.

The weight and size of such construction elements is very decisive, not only regarding the production costs but also for the price for the building for which such construction elements are used, in that the transport costs are increasing due to higher energy prices, as well as tax on air pollution. It is thus important that the weight of said construction elements is as low as possible, though with regard being paid to the achieving of the necessary stability of the building in which the construction element forms part. Moreover, the weight of the elements also plays a role with regard to the ease with which they can be handled, in connection with the placing of the elements, inasmuch as the use of the construction elements of the kind disclosed demands a high degree of precision in connection with their mutual positioning. A heavy construction element will thus be difficult and slow to turn/manoeuvre hanging from a crane, whereas a construction element of light construction will be correspondingly easier to handle.

It is thus the object of the invention to provide a construction element of the kind disclosed which fulfils the demand regarding least possible weight, and which is consequently easy to handle and to position in a consecutive building construction.

This object is achieved with a construction element of the kind disclosed, in which the external side surfaces comprise insulating material which, when brought together with corresponding side surfaces, forms a stable element which constitutes a permanent insulating cladding for the later in-situ-moulded supporting structure and the protruding ribs on the external surface are formed in the insulating material.

There is hereby achieved a light construction element, in that the walls do not need to be constructed in such a manner that these can support a number of construction elements placed on top of one another, but are intended merely to be able to function as a permanent cladding together with construction elements placed at the side of said construction element. In the construction of multi-storey buildings, there is thus first carried out a casting of the cavities which are formed between two facing sides for the formation respectively of columns and beams for supporting the storey lying above, which is similarly built up of construction elements according to the invention which are placed at the side of one another, after which there is again carried out a casting of the cavities created between two facing sides for the formation respectively of columns and beams for supporting of the storey/storeys lying above, and this is thus continued until the building has reached the planned height. After the casting of columns and beams, the building is more or less finished, since all of the construction elements forming the internal sides will appear as fully finished, containing electricity, water and other installations for the building.

As the external side surfaces comprise insulating material, this can help to achieve an appropriate inner climate and noise suppression in a building constructed with construction elements according to the invention.

It is thereby achieved that such a construction element can be used for the construction of buildings in cooler regions, inasmuch as the insulation safeguards against too much heat loss and thus against a high consumption of energy. Conversely, the insulation can also serve to insulate the rooms in the building against strong heat influences where the construction element forms part of buildings constructed in warmer regions. Moreover, the presence of insulation material between the individual construction elements suppresses noise between the elements.

It is thereby achieved that the insulation material can be used as "moulding underlay" in connection with the casting of the side surfaces of the construction element, while at the same time the opposite side, the external side, can be used as permanent cladding in connection with the casting of the building's supporting structures (columns and beams).

With the object of ensuring parallelism and spacing, and compensation for irregularities between the inner side and outer side of the construction element, one side of the insulation can be configured with holes, grooves or outwardly-facing fields which can be pressed into the unhardened material of the inner wall to absorb irregularities and height differences and, moreover, the side of the insulation facing towards the outer side of the construction element can be configured with profiles which make possible the mounting of installations in both the vertical, horizontal and inclined plane, at the same time that the ribs form insulated casting channels for the supporting structure.

It is thereby achieved that the thickness of the insulation can be tailor-made to the desired or required degree of insulation, and by casting/bringing together with the wall material form a unit which both sound- and temperature-wise insulates the construction elements from each other without cold bridges. At the same time, the ribs can be configured in such a manner that parts of the rib can be removed (broken, cut, milled, ground off or flame-cut), and installations (electricity, water drainage and the like) can be sunk into the rib and possibly secured with a plastic clip. The back (rear side) of the ribs can be configured in a stepped manner, which provides a visual cutting line when installations of different diameters are secured manually into the rib. Moreover, this opens the possibility of meeting the demand that empty, closed, unfilled channels in the insulation shall be able to be aired to avoid the formation of condensation in the cavities.

With the object of easing the placing and securing of reinforcing rods during the production of the construction element, the insulation can comprise holes/recesses for the mounting of clips for securing of the reinforcement rods during casting.

The advantage is thereby achieved that the reinforcement does not need to consist of welded net, but can be secured in both the vertical and horizontal plane as individual reinforcement rods. This provides the possibility for the use of reinforcement such as rolled-up wire, straightened and shortened to relevant length, thereby to avoid wastage and joints.

Clips can be mounted through the insulation from the outer side, and secured in position via step-formed hold-down elements and hold-down wings which swing out during assembly.

Insulation for a whole wall side can thus be stored in separate holders/fixtures where it can be secured with vacuum, clips mounted as required and reinforcement clamped firmly in the plastic clips.

The whole insulation side may be turned/lowered down into unhardened concrete where it is pressed/vibrated into place.

With the object of easing the placing of the reinforcement with the establishing of a structure in which the construction element is used, the insulation material can comprise moulded holes/recesses for receiving and securing of the reinforcement for strengthening of concrete which is applied to it or the cavities which are formed by combination of said relevant facing profiles.

The possibility is thereby achieved for a quick and precise positioning of the necessary and adequate reinforcement of the columns which are cast by the pouring of concrete into the cavities. Moreover, it is ensured that the reinforcement sits exactly as it should, which is possible with prefabrication of construction elements according to the invention with reinforcement rods inserted/anchored in the insulation material/the wall below.

With the object of rendering the placing of the reinforcement in the side walls of the construction element even more effective, towards the casting side of the insulation material it can comprise protrusions/raised parts with end surfaces which comprise a cruciform slot for receiving of reinforcement rods, which are pressed into said slots.

The possibility is thereby achieved of saving time which is involved in the insertion of clips for the fastening of the reinforcement, in that the reinforcement rods can be placed and secured in the correct position by the pressing of these into the slots.

With the object of ensuring a precise height and horizontal positioning of the construction elements which are placed on top of already positioned elements, and to facilitate a quick placing of the construction elements on top of each other, the ceiling side of the construction element can comprise a number of recesses for insertion of a number of vertically-oriented, adjustable and lockable guide pins extending from the outer side of the ceiling side, said guide pins cooperating with recesses in the external downwardly-facing side of the construction element (the upper floor side).

With the object of further ensuring a correct positioning of the construction element according to the invention, above and between the upright guide pins on facing sides of adjoining construction elements there can be a distance piece with a circular opening (a round hole) for receiving (for placing over) the one guide pin, and an elongated hole for placing over the second guide pin with a scale along at least the one straight side for reading of tolerances in the erection of the construction elements.

It is thereby ensured partly that the mutual distance between the construction elements can be kept within a certain tolerance, and also that within this to be able the control whether the construction element tapers or opens, i.e. whether the levelling at the guide pins is effected correctly.

With the object of providing the possibility for quick and easy guiding of a construction element into the correct position, between the upstanding guide pins above the distance piece there may be provided a bow-shaped, upwardly-directed guide arrangement.

In a specially preferred embodiment, the bow-shaped upwardly-directed guide element has the form of an inverted V-shaped profile, the free ends of the respective legs of which comprise a mutually parallel extent, each of the parallel extents comprising an angle-bent part bluntly extending away from the centre transverse plane of the V-profile, where the bluntly extending part comprises a circular cut-out/hole.

The possibility is thereby achieved of ensuring a precise positioning of a construction element according to the invention by means of a building crane, so that the external insulation is not damaged, and also for matters of security, inasmuch as it is not necessary for persons to come close to the construction element during the mounting, but personnel can merely "roughly control" the element with ropes or staves at a safe distance.

In a further preferred embodiment, the bow-shaped upwardly-directed guide element and the distance piece can be integrated, where one of the bluntly extending parts comprises a circular cut-out/hole, and another of the bluntly extending parts comprises an elongated or circular cut-out which is placed above the elongated cut-out/hole in the distance piece. It is thereby achieved that the distance piece and the bow-shaped upwardly-directed guide element become easier to handle and position during erection of the structure in which the construction element forms part, while at the same time it is possible to carry out a control of the extent to which the mutual placing between two consecutive construction elements is correct.

With the object of ensuring as good a tightening as possible between protruding ribs in connection with the formation of sealed channels intended for casting with the view of establishing an integrated supporting structure in a building comprising construction elements according to the invention, the protruding ribs can have end surfaces with integrated extending strips of rubber.

With the object of easing the construction of those sides which form part of a construction element according to the invention, the wall sides can be built up as moulded frame constructions, with beams along the outer edges, and where the area demarcated by the frame is cast with light-weight concrete.

Figure 2:
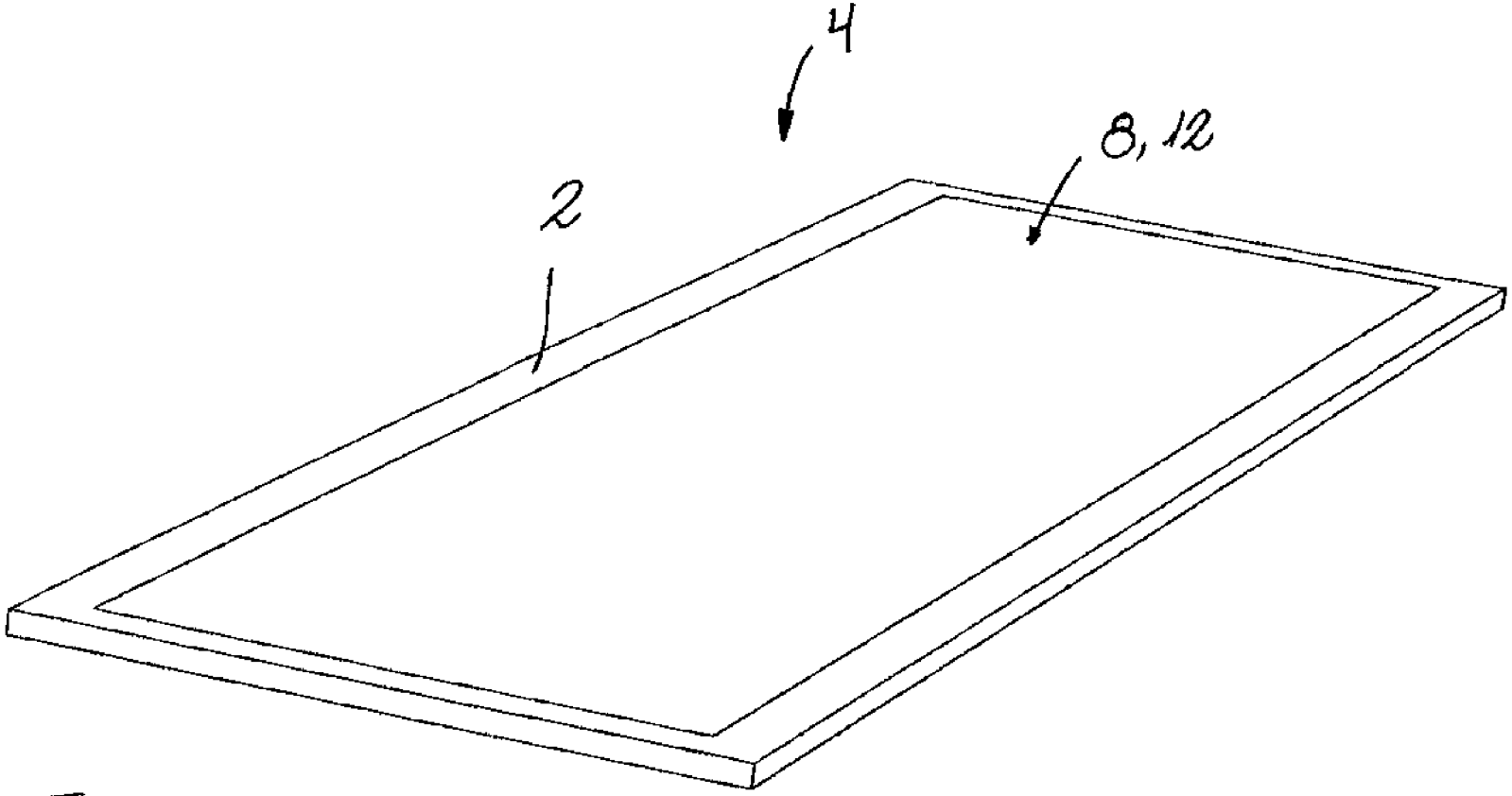
Figure 3:
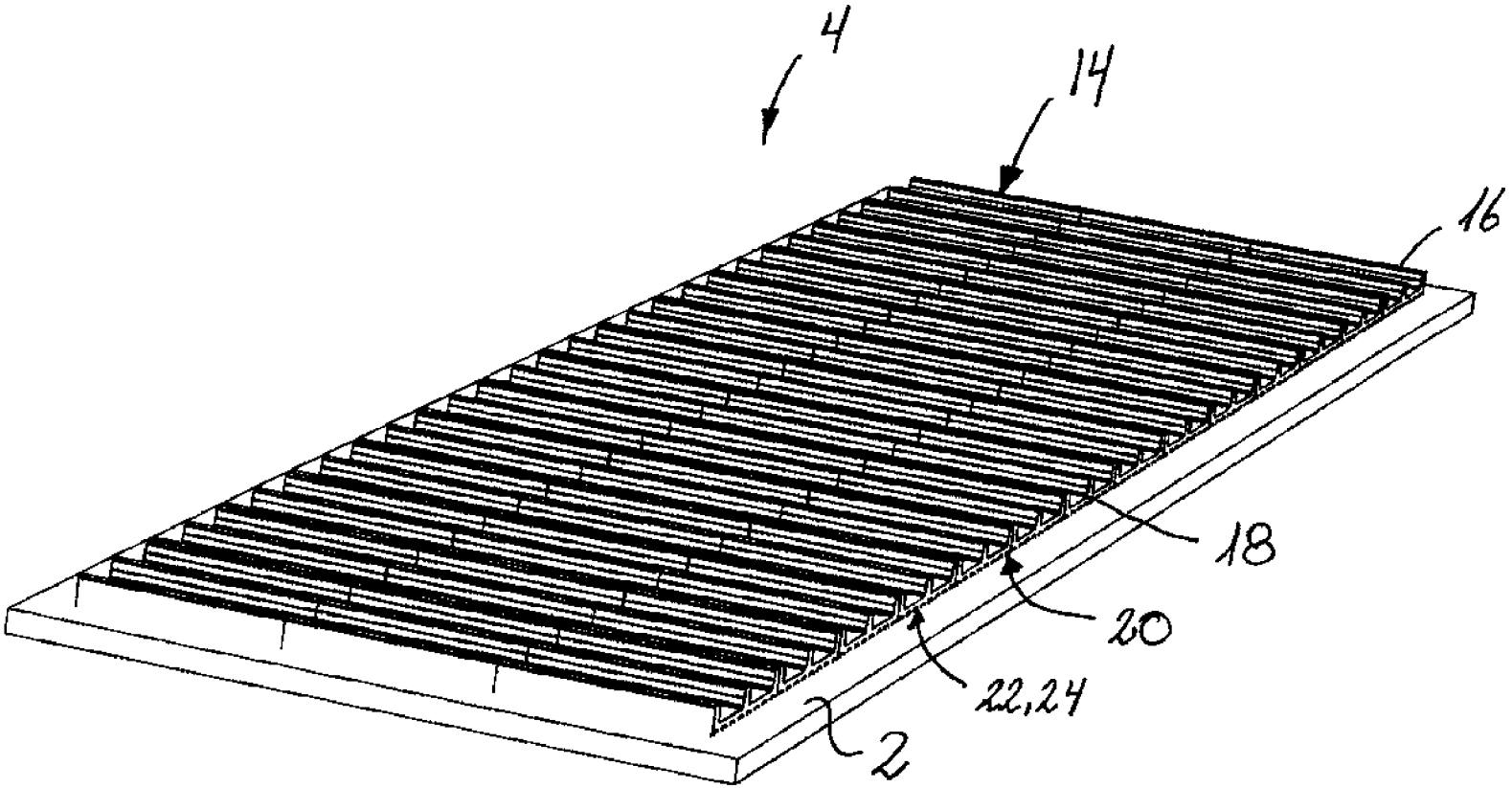
Figures 4, 4A, 4B:
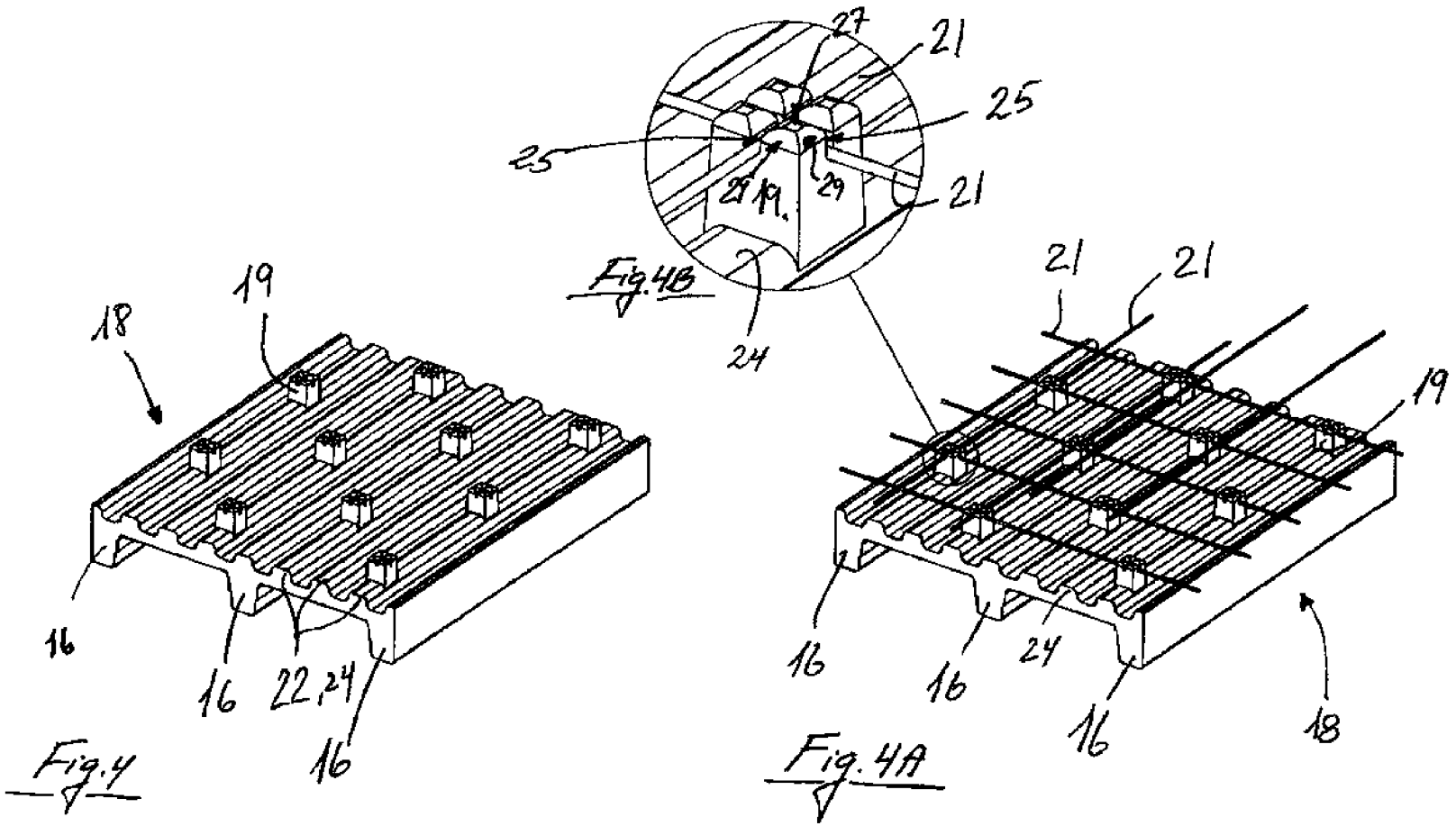
Figure 5:
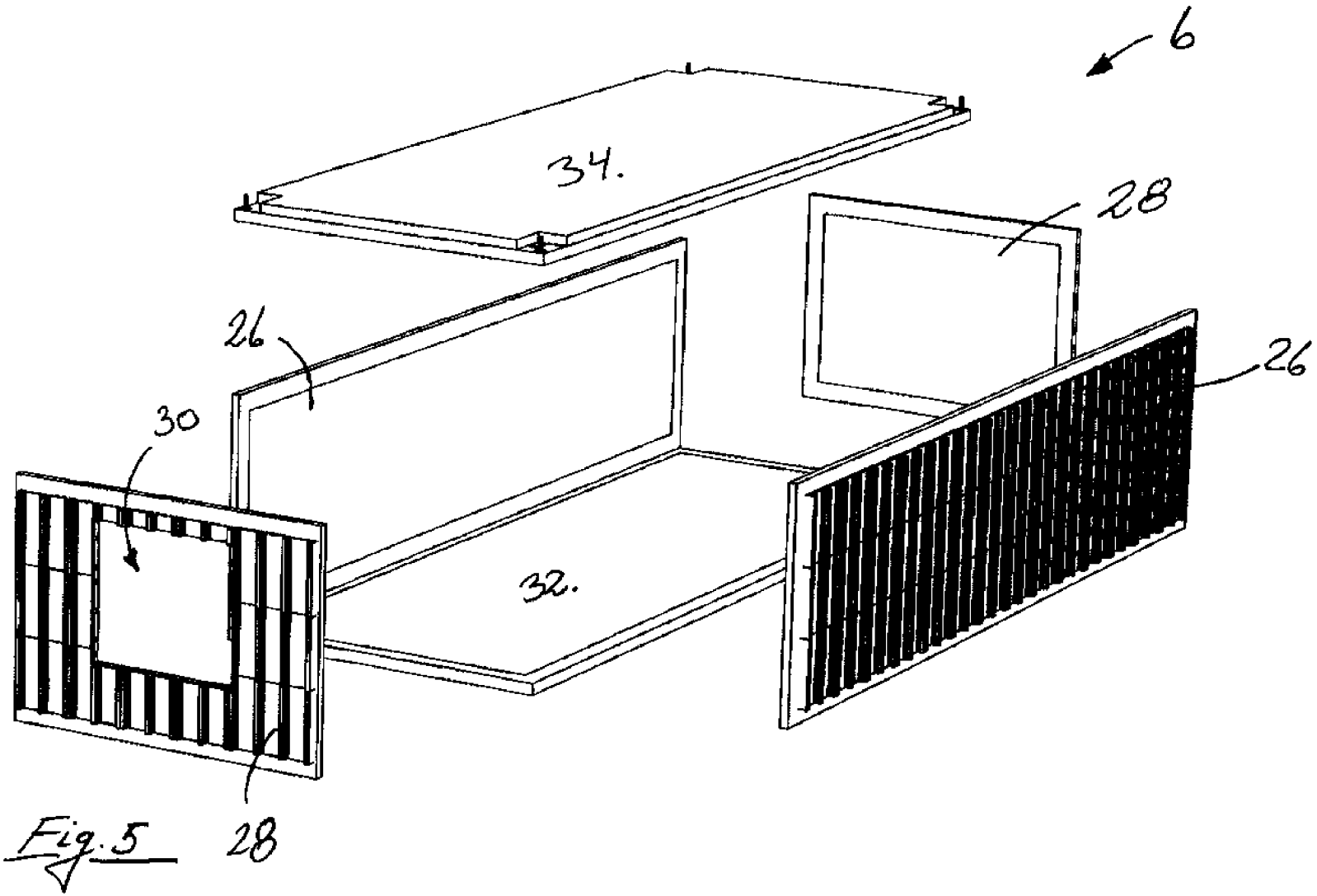
Figure 6:
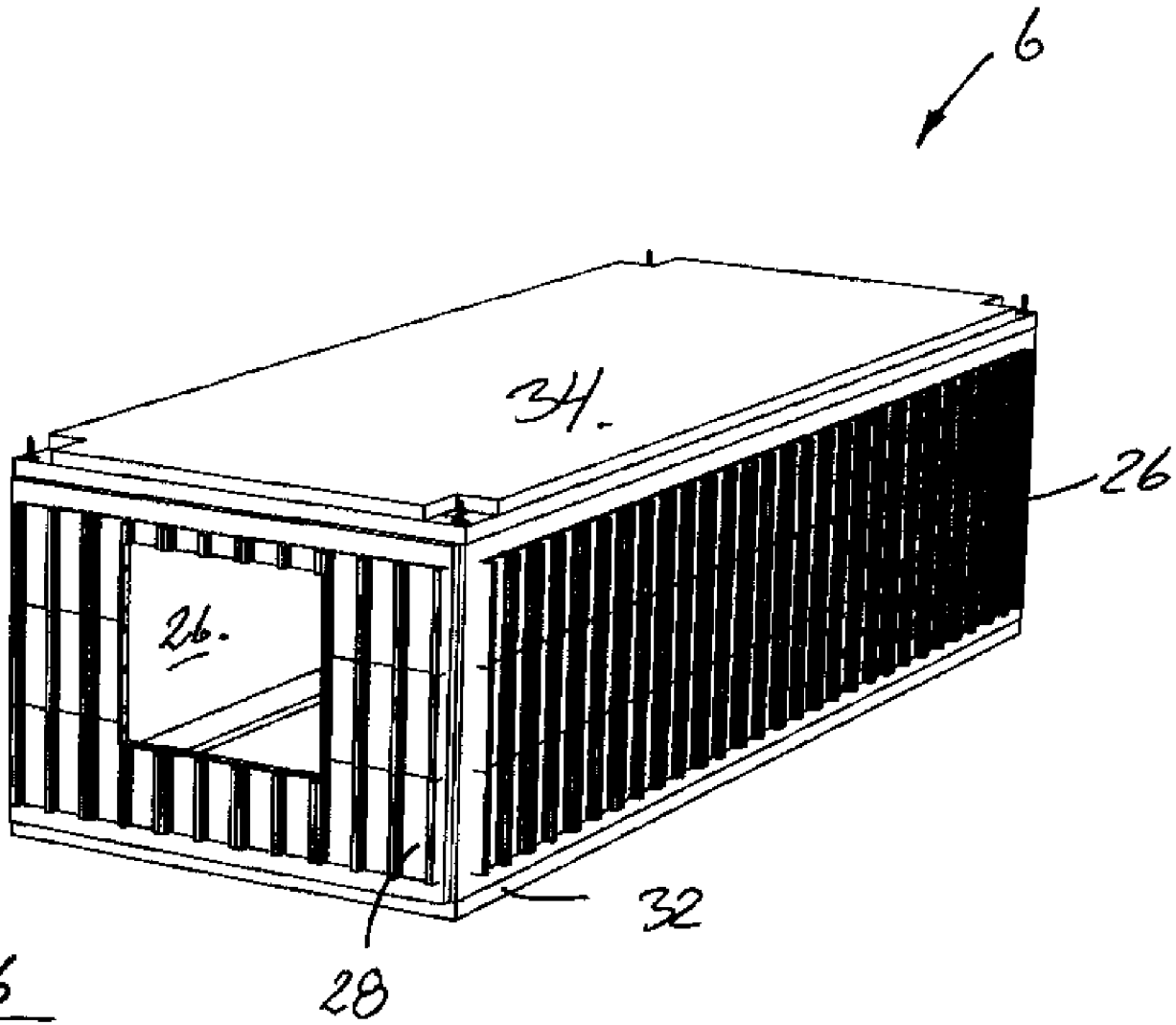
Figure 7:
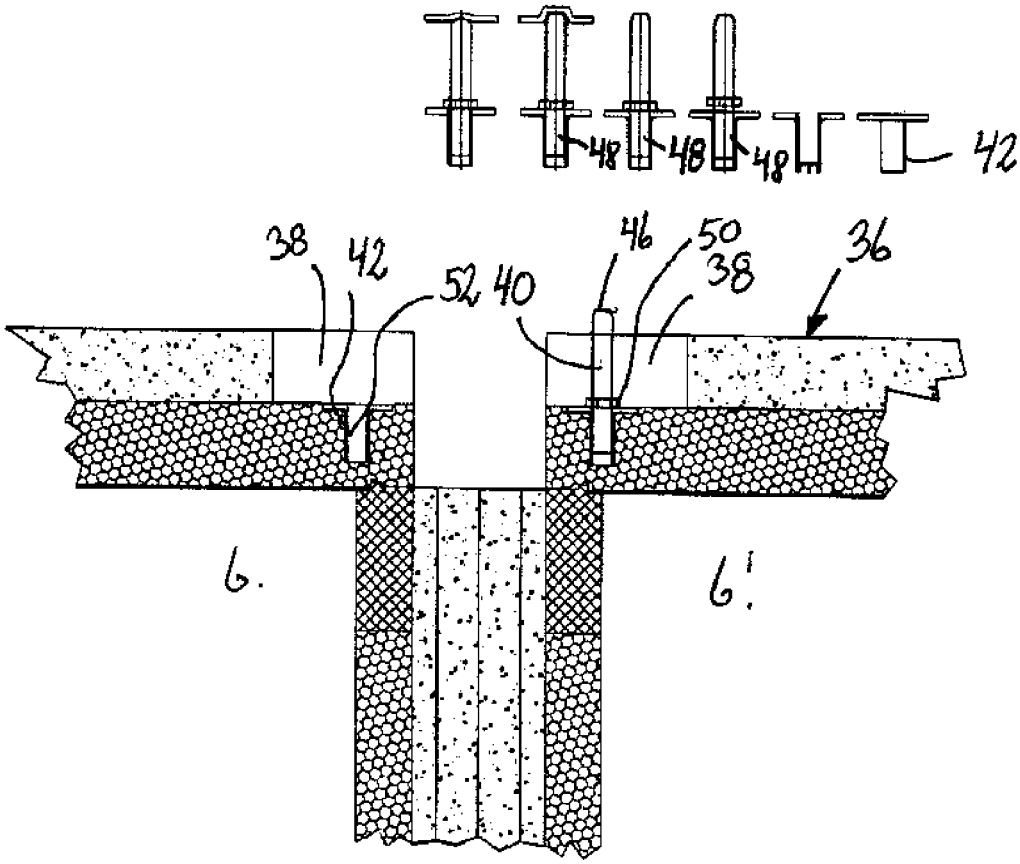
Figure 8:
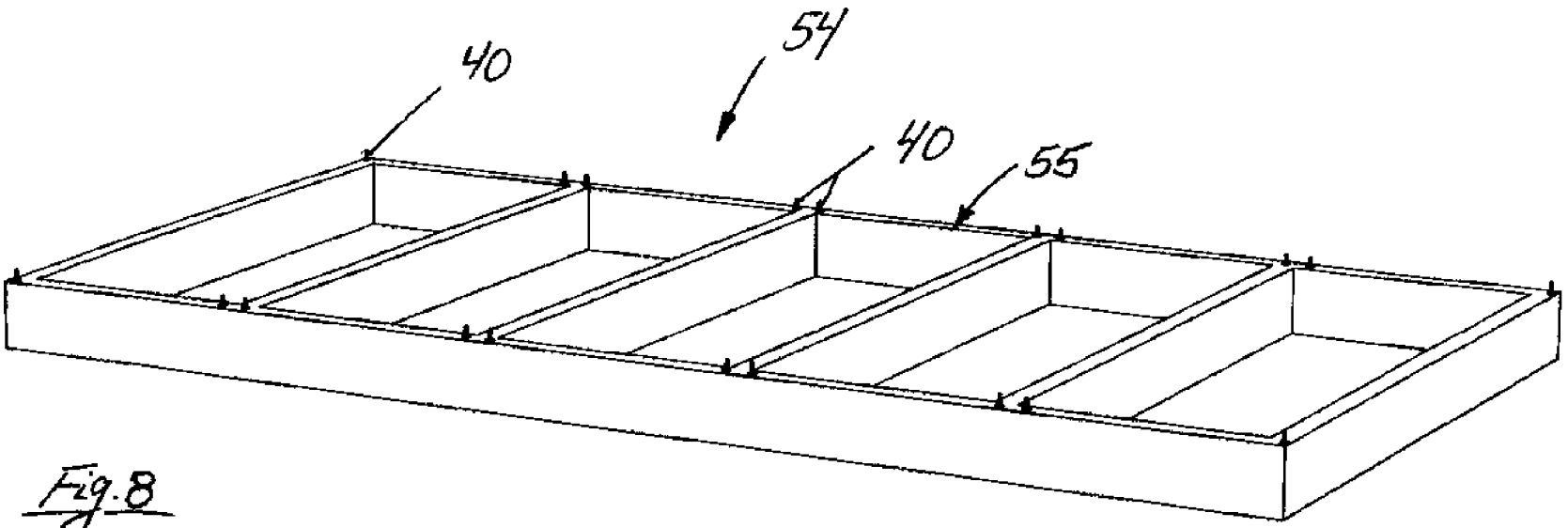
Figure 9:
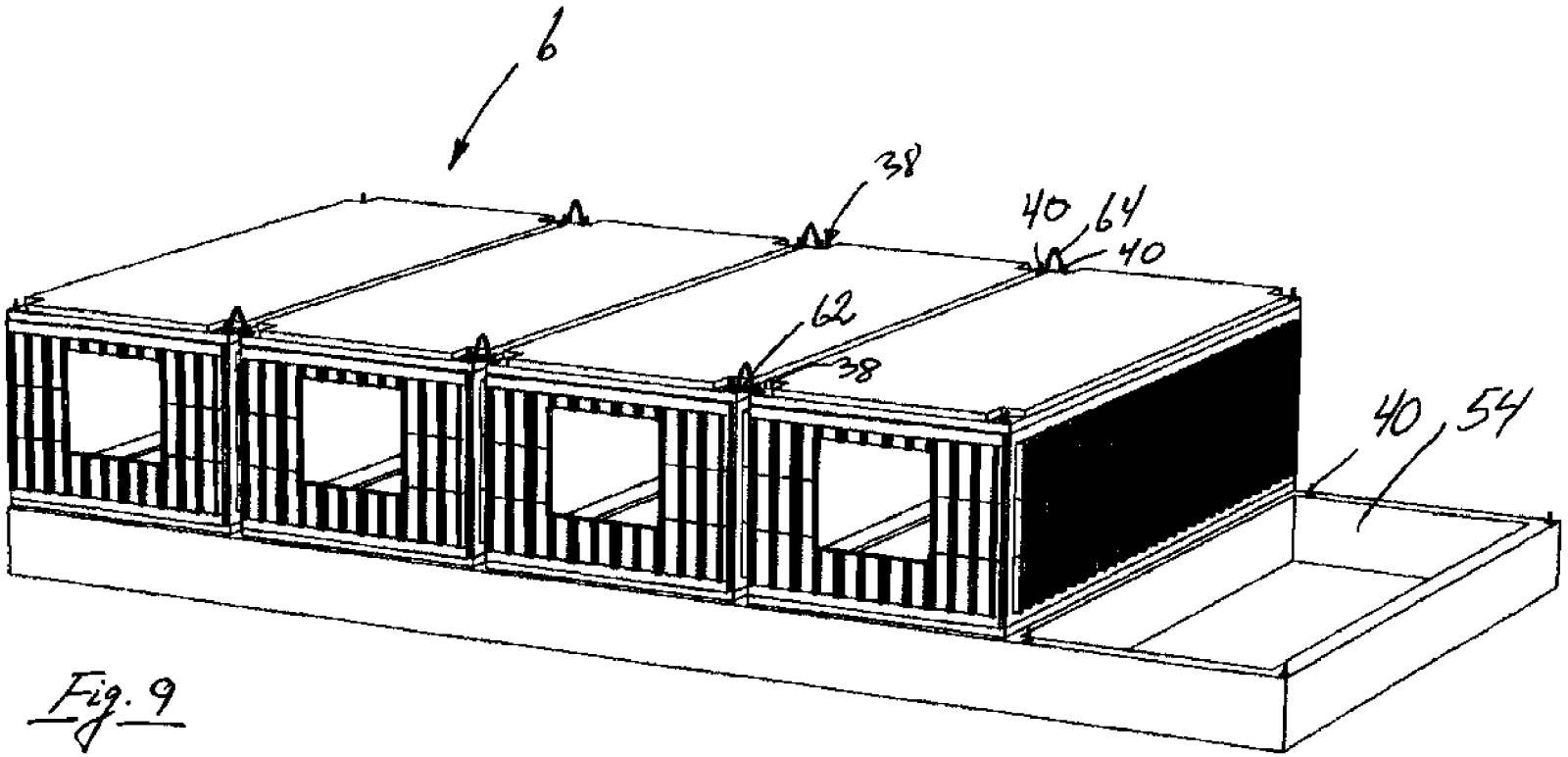
Figure 10A:
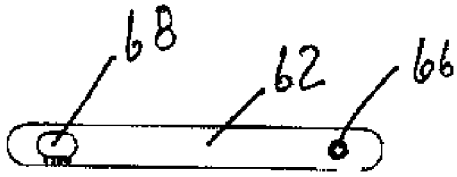
Figure 10:
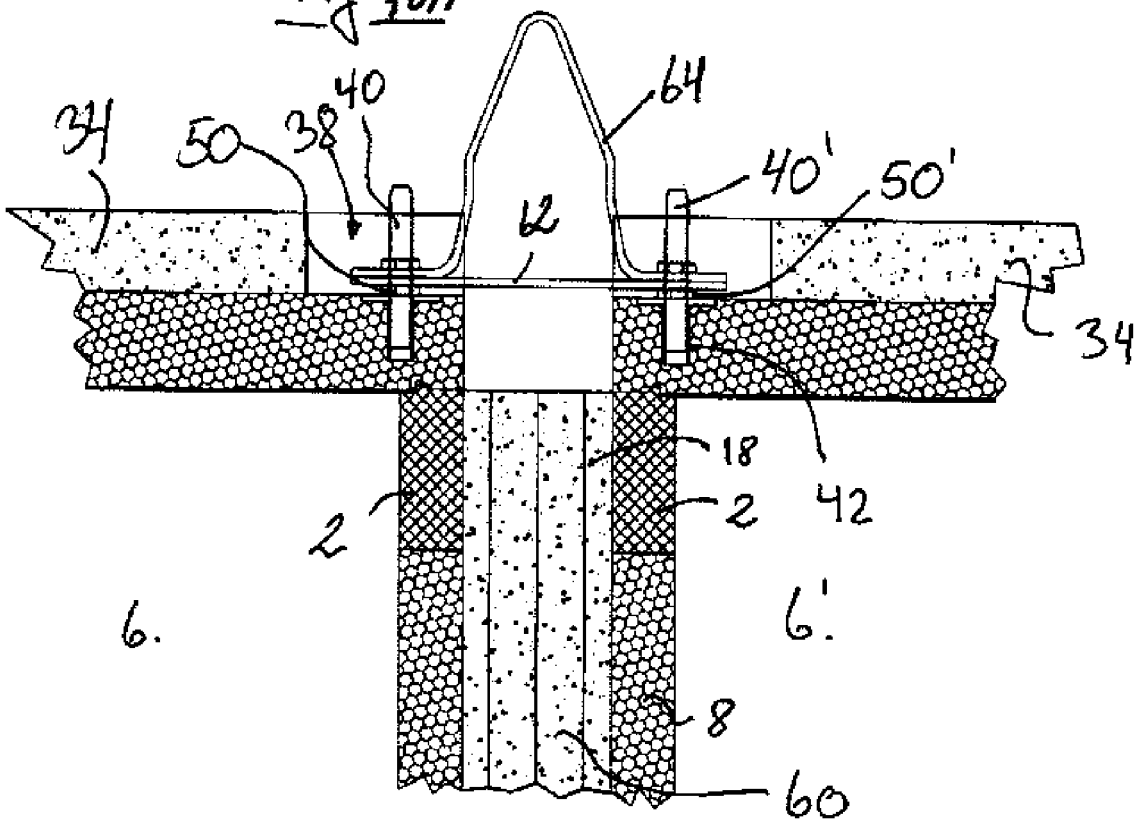
Figures 11, 12, 13, 13A, 13B:
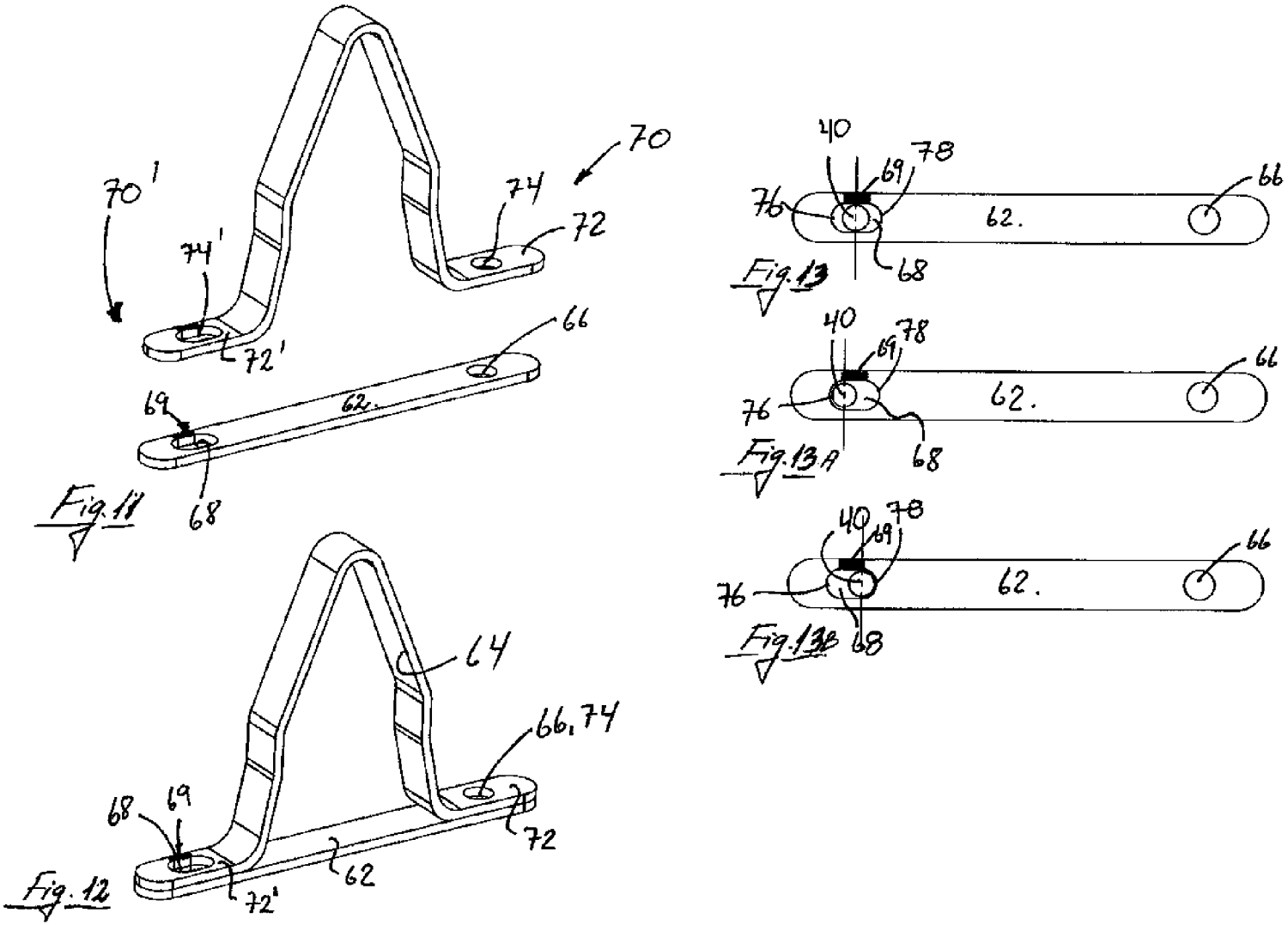
Figure 14:
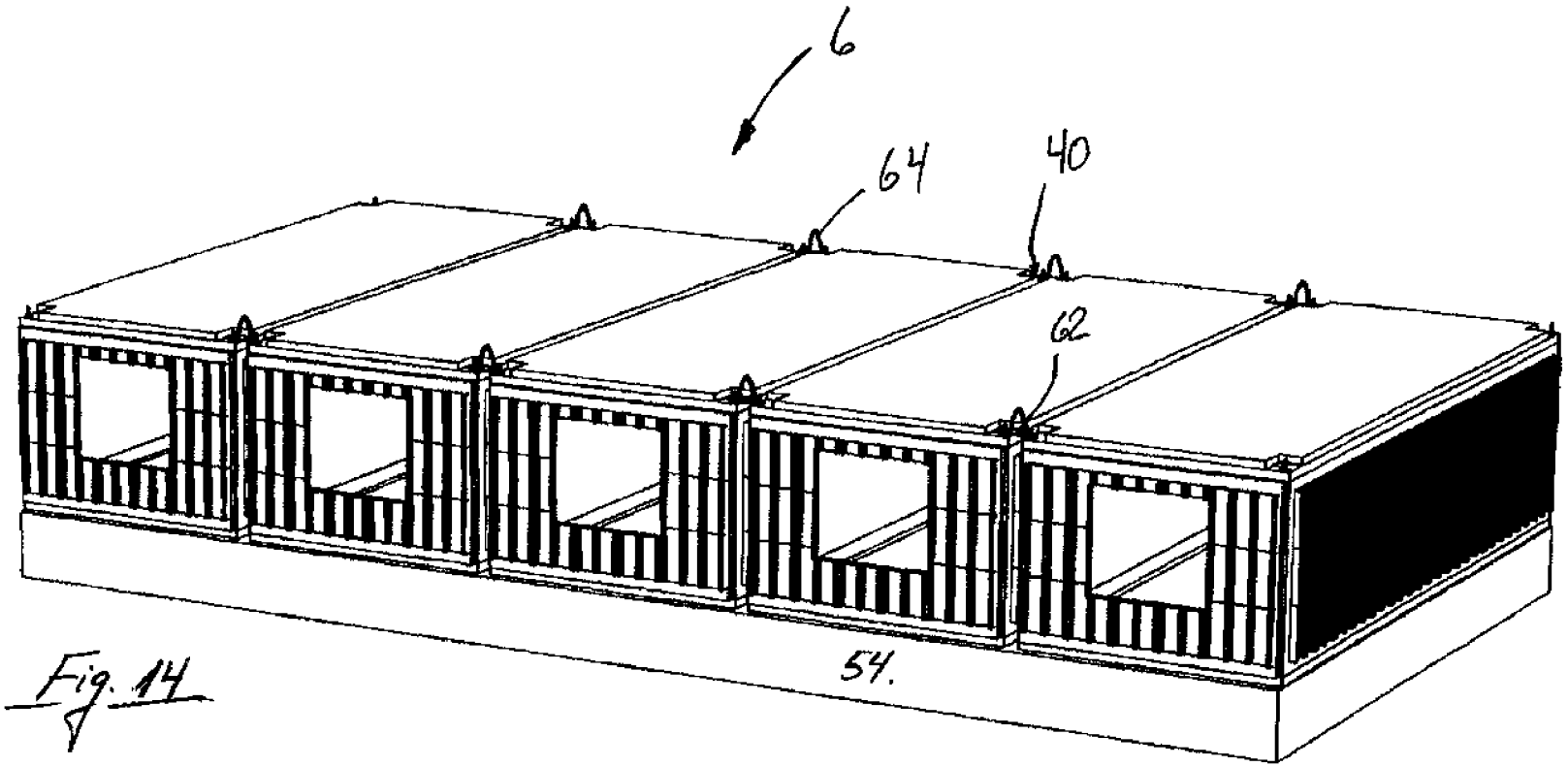
Figure 15:
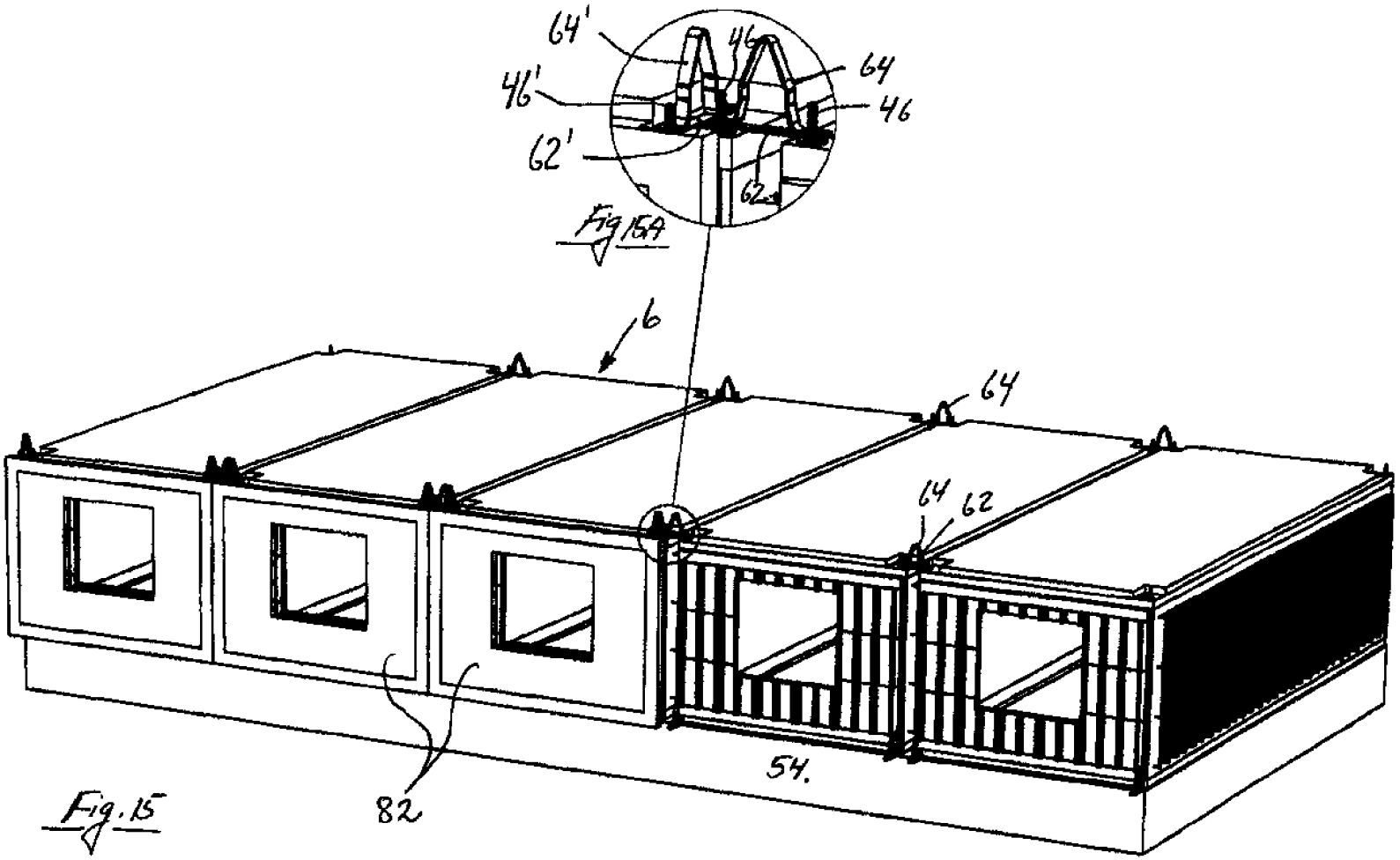
Figure 16:
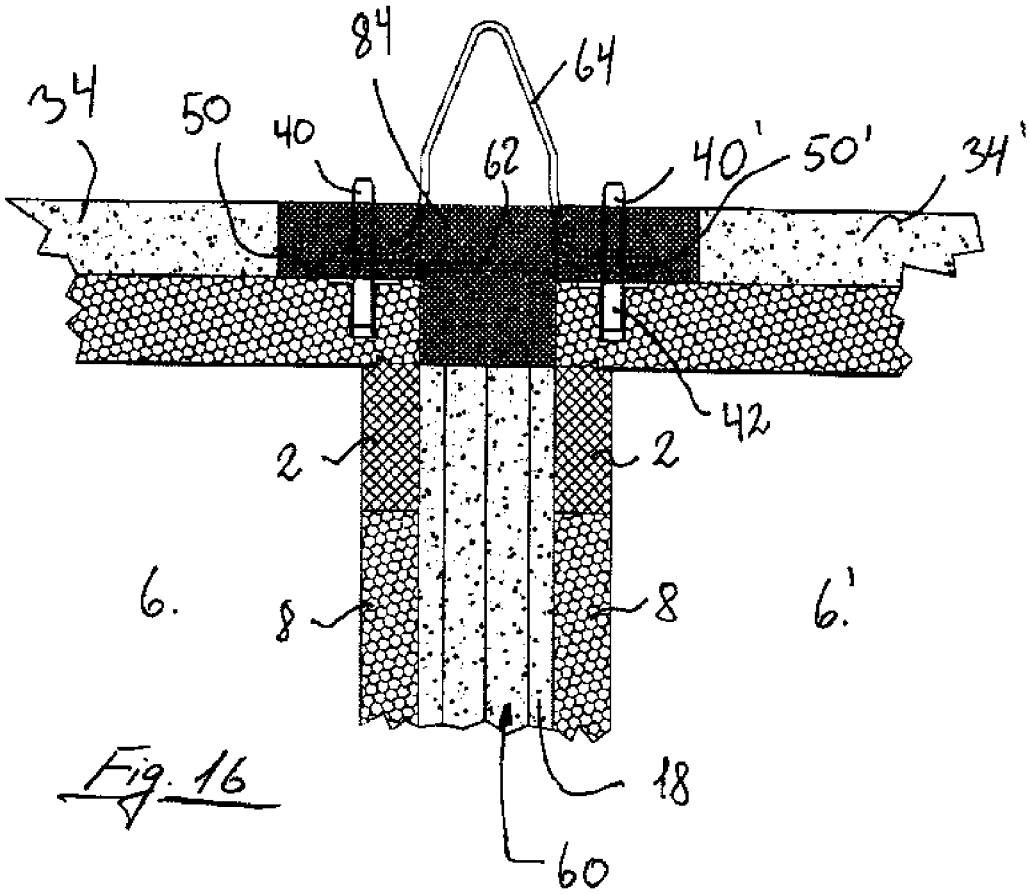
Figure 17:
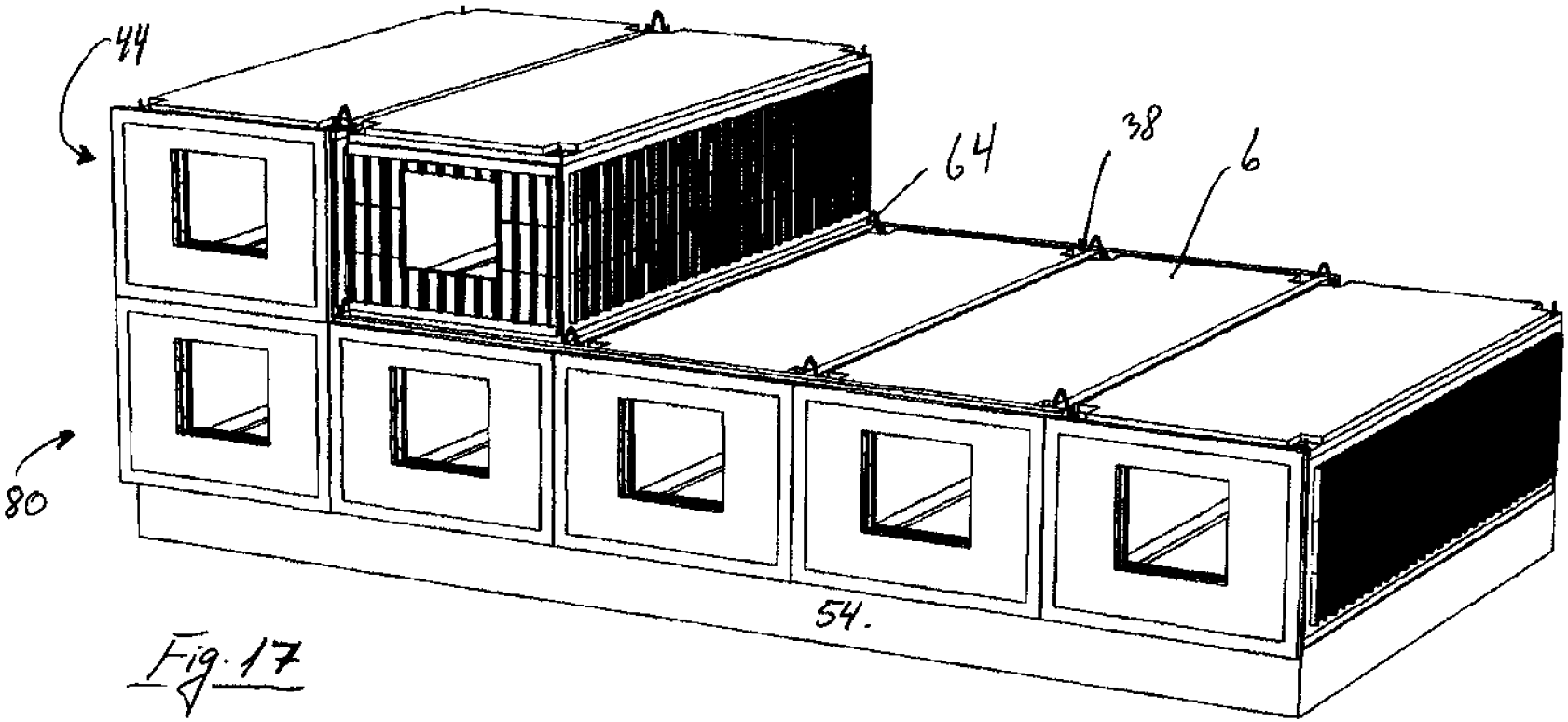
Figure 18:
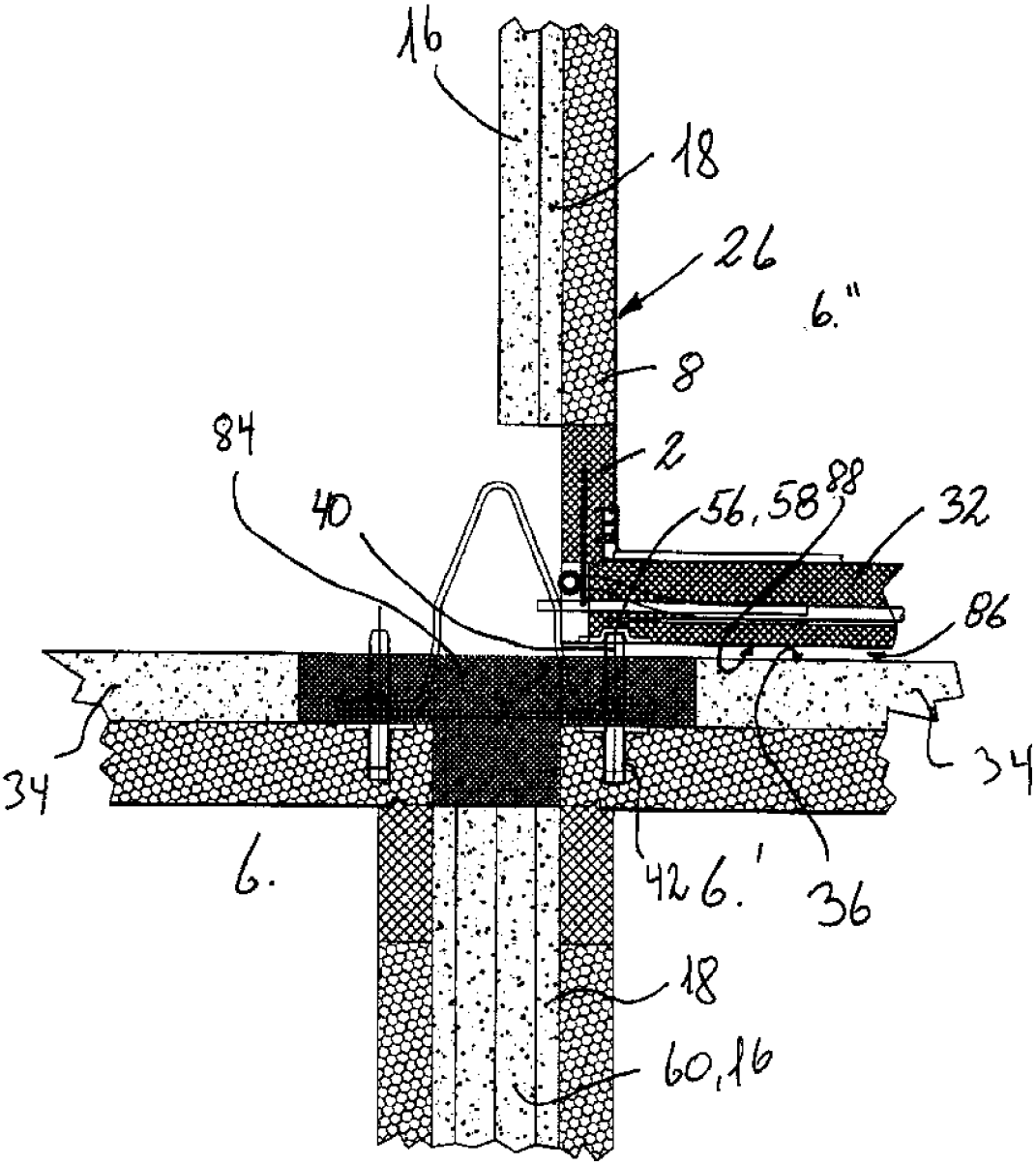
Figure 19:
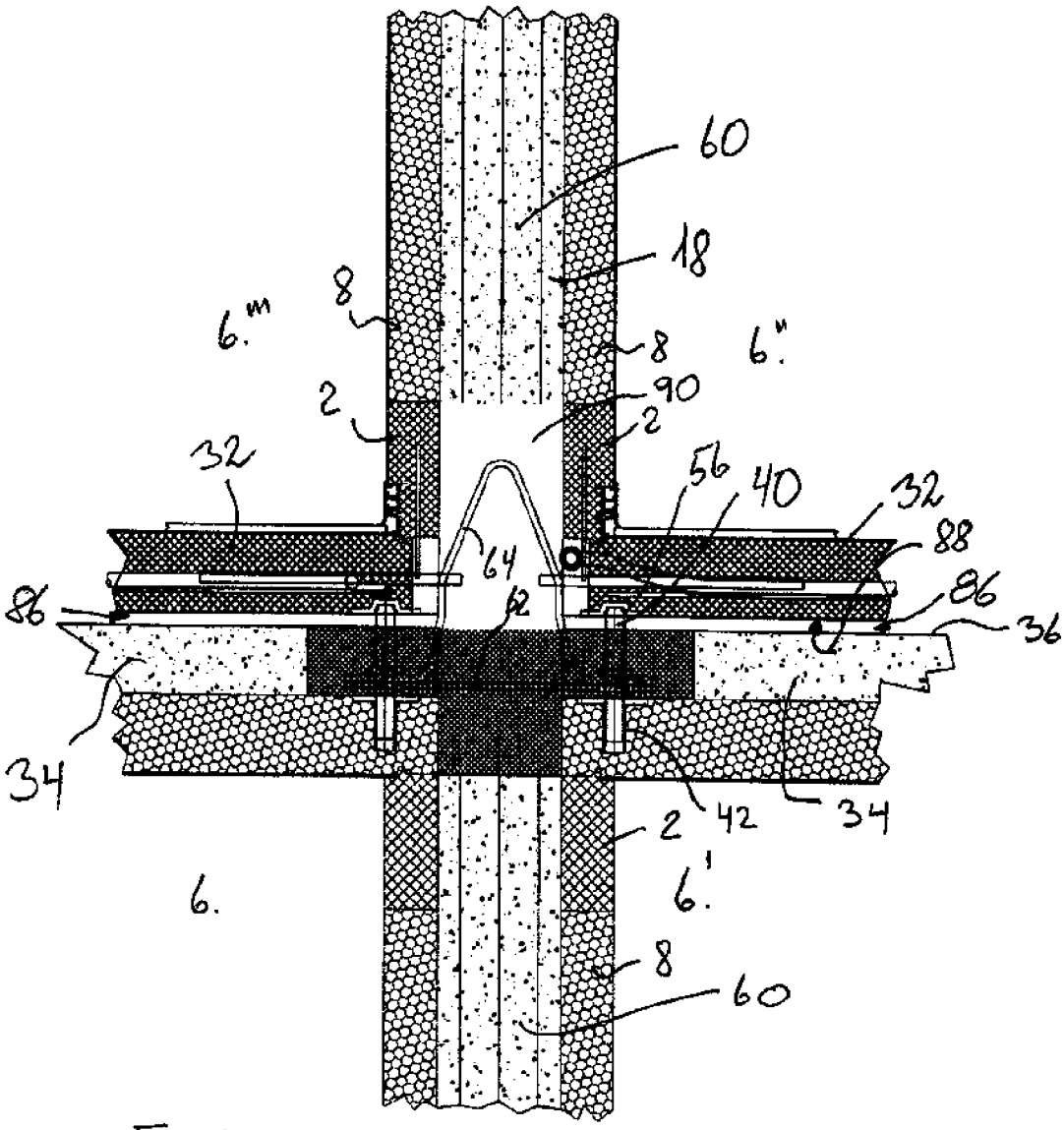
Figure 20:
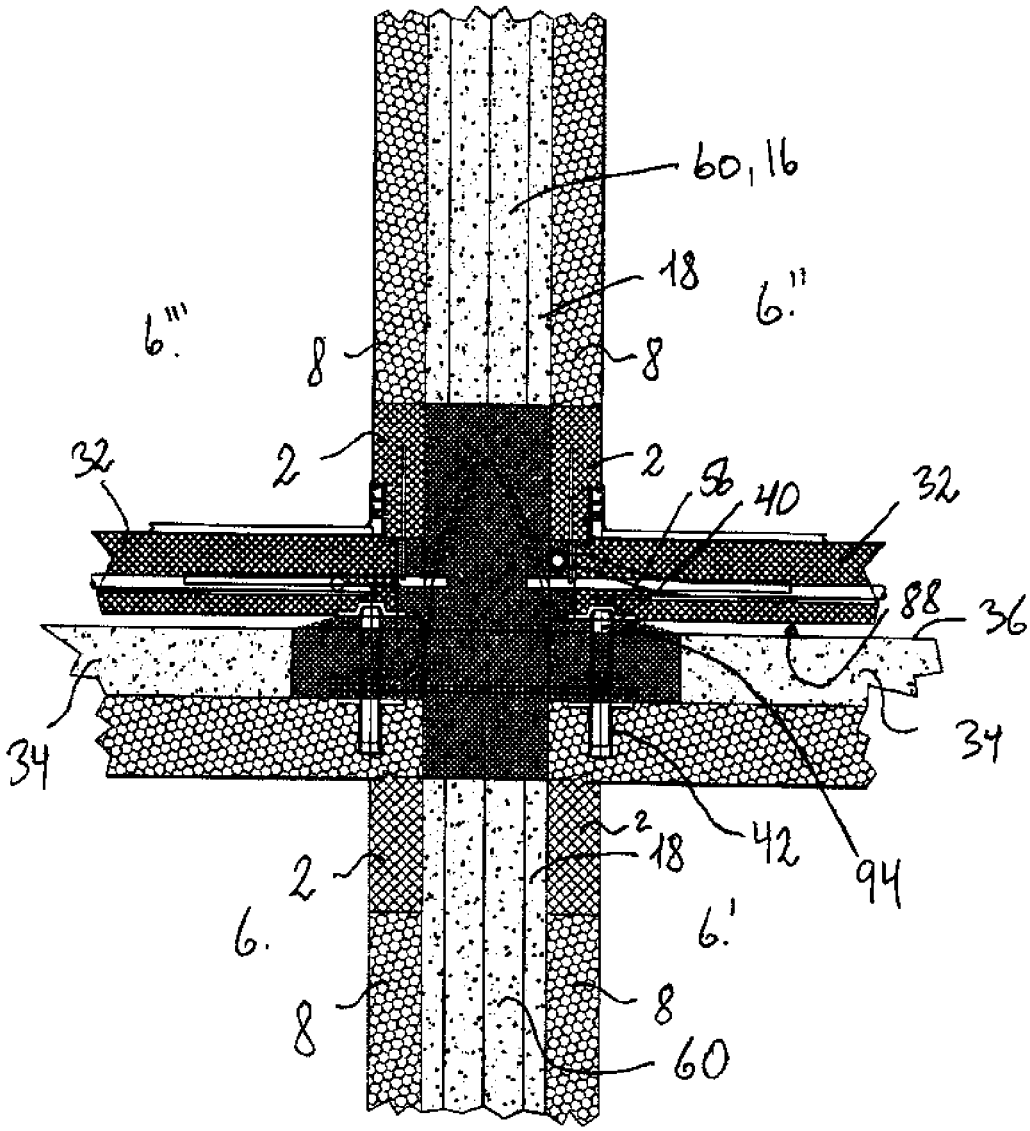
Figure 21:
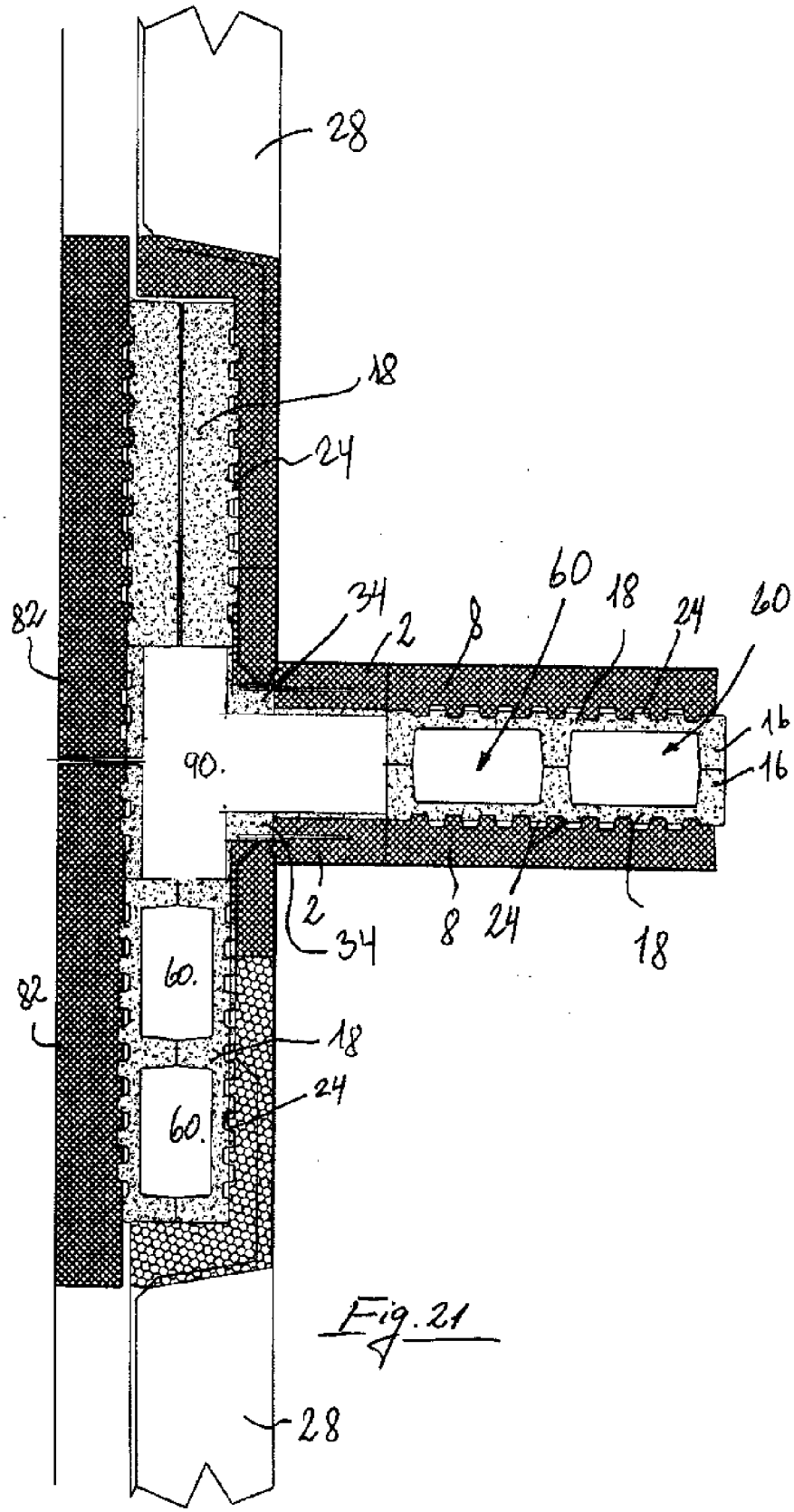
Figure 22:
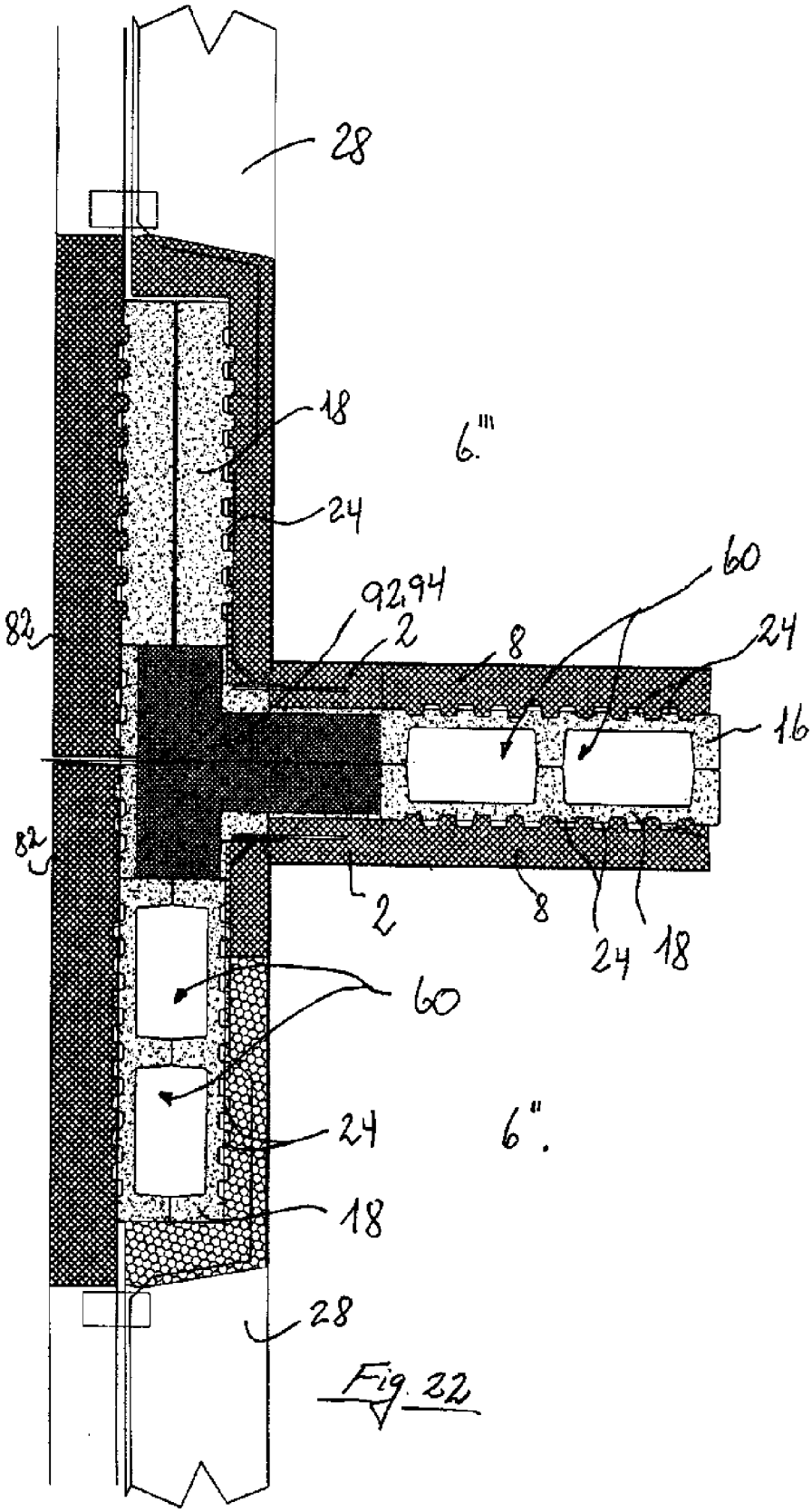

In the following, examples of the invention are explained in more detail with reference to the drawing, where FIG. 1 is a perspective view of a frame of reinforced concrete for a construction element according to the invention, FIG. 2 shows the same as in FIG. 1, but where the concrete side is cast with leca-concrete, with an internal side upwards, FIG. 3 shows the same as in FIG. 2, but with an external, insulated side upwards, FIG. 4 shows an embodiment of an insulating material which is used in the concrete side, where the insulation material comprises protrusions for receiving and securing of reinforcement rods, FIG. 4A show the same as in FIG. 4, but where reinforcement rods are inserted in the protrusions, FIG. 4B is a detail section of FIG. 4A, which shows how the reinforcement rods are secured in the protrusions, FIG. 5 shows an example of the sides of which an example of a construction element according to the invention consists, FIG. 6 shows the same as in FIG. 5, where the construction element is assembled, FIG. 7 shows a detail in the construction element shown in FIG. 6, comprising a guide pin, FIG. 8 shows an embodiment of a base for the erection of a building consisting of construction elements according to the invention, FIG. 9 shows the base shown in FIG. 8, on which construction elements according to the invention are placed successively in a row, FIG. 10 shows a detail of the construction elements shown in FIG. 9, comprising a distance control element and a guide element according to an embodiment of the invention, FIG. 10A is a detail view of the distance control element, FIG. 11 shows the distance control element and guide element as separate parts, FIG. 12 shows the distance control element and guide element as an assembled unit, FIGS. 13, 13A and 13B show examples of the use of the distance control element, FIG. 14 is a perspective view of the base shown in FIG. 8, where the base is filled up with construction elements according to the invention placed in a successive row at first level, FIG. 15 shows the same as in FIG. 14, but where some of the construction elements according to the invention are provided with facade cover-plates, FIG. 16 is a vertically-oriented cross-section of a section between two consecutive construction elements according to the invention, FIG. 17 is a perspective view of the building shown in FIG. 14, during the mounting of construction elements according to the invention at a second level, FIG. 18 is a vertically-oriented cross-section of a section of three adjoining corners of three construction elements according to the invention, FIG. 19 is a vertically-oriented cross-section of a section of four adjoining corners of four construction elements according to the invention, FIG. 20 shows the same as in FIG. 19, but where a casting has been carried out of cavities between the four construction elements according to the invention, FIG. 21 is a horizontally-oriented cross-section of a section between two successive construction elements according to the invention, and FIG. 22 shows the same as in FIG. 21, but where a casting has been carried out of the cavity between the two construction elements.

In FIG. 1 there is shown a perspective view of an embodiment of a frame 2 of reinforced concrete for a concrete side 4 cf. FIG. 2 and FIG. 3 for a construction element 6 cf. FIG. 5 and FIG. 6 according to the invention.

In FIG. 2 is seen the frame shown in FIG. 1 cast with light-weight concrete which is poured into the space 10 within the frame 2, but with the side 12 facing the internal side of the construction element oriented upwards. The light concrete 8 can, for example, consist of leca-concrete, and be concluded at the same level as the frame 2.

In FIG. 3 is seen the concrete side 4 shown in FIG. 2, but with the external side 14 facing upwards. As will be seen, the external side 14 comprises a number of parallel, protruding ribs 16 extending from the concrete side 4. The ribs 16 are formed by the moulding-in of a suitable insulation material 18 in the light concrete 8, where the insulating material 18 is beforehand wholly or partly formed with the ribs 16. The insulating material 18 can consist of styropor or a similar stable material, which together with the concrete side 4 is suitable as a permanent cladding. As will further appear from FIG. 3, the side 20 of the insulating material 18 facing the light-weight concrete 8 comprises a corrugation 22 which, in the embodiment shown, consists of smaller ribs 24 which are sunk into the wet light-weight concrete 8 to achieve a suitable and firm securing of the insulation material 18 on the concrete side 4.

In FIG. 4 there is shown an embodiment of the insulation material 18 intended for moulding into the frame 2. The insulating material comprises larger ribs 16 extending in parallel on one side, and seen more clearly here is the corrugation 22 shown in FIG. 3, consisting of smaller ribs 24 which are intended for pressing-down into the wet light concrete during the casting of the frame 2. As will appear from FIG. 4, the corrugation 22 comprises a number of projections 19 which are disposed in a parallel manner in both the longitudinal and the transverse direction of the corrugation 22.

As also appears most clearly in FIG. 4B, which is a detail section of FIG. 4A, the projections comprise a cruciform slot 25 which is similarly oriented in parallel in both the longitudinal and the transverse direction of the corrugation. The cruciform slot 25 is intended for the receiving and pressing-in of reinforcement rods 21 in a cross-reinforcement, which is indeed for the strengthening of the concrete which is used for the casting of the opening 10 in the frame 2. In order to ease the pressing of the reinforcement rods 21 into the cruciform slots 25, the tops 27 of the slots are provided with chamfers 29, as will appear from FIG. 4B.

As will also appear from FIG. 4A, which shows the same as in FIG. 4, but where reinforcement rods 21 are inserted in the slots 25 in the projections 19, the projections 19 will ensure that the reinforcement is disposed at a suitable distance from the insulation material corrugations 22 when these are pressed down into the wet concrete which is used for the casting of the frame 2 (cf. FIG. 1).

FIG. 5 shows an exploded perspective view of an example of a construction element 6 according to the invention, which in FIG. 6 is shown in the assembled state. In the embodiment shown, the construction element 6 comprises two long sides 26, two short sides 28, the one of which comprises a window opening 30, a floor side 32 and a ceiling side 34. It will be obvious that one of the long sides will comprise a door opening (not shown) to provide access to and from the room which is defined by the sides 26, 28, 32, 34 of the construction element. Moreover, these other sides can also have openings.

As also appears from FIG. 5, FIG. 6 and FIG. 7, the external side 36 of the ceiling side 34 comprises a recess 38 at each of the corners. In each of the recesses 38 there is an upright guide pin 40 which is housed in a bush 42 moulded into the ceiling side 36. The guide pins 40 extend some distance up above the external side 36 of the ceiling side 34, and are intended to be received in holes cooperating therewith at the corners of the floor side of a construction element 6 positioned on top of the construction element at the second level 44 of a building consisting of construction elements 6 according to the invention, which among other things will appear from FIG. 17, FIG. 18 and FIG. 19.

In FIG. 7, which is a detail section of the corners of two consecutive construction elements 6, 6', it is seen how the bushes 42 are moulded into the ceiling side 34, and how a guide pin 40 is inserted into the bush 42 with the free end 46 extending up to a level lying above the external side 36 of the ceiling side 34. The object of the guide pins 40 is to ensure a uniform, parallel and correct positioning of the individual construction elements 6 of which the building consists. As further indicated in FIG. 7, a part of the end 48 of the guide pins facing the bush 42 can be cut with a thread and be provided with a counter-nut 50 for securing the guide pin 40 in a desired position. Moreover, the bush 42 can comprise a thread 52 which cooperates with the threaded end of the guide pin, so that a tightening of the counter-nut will fix the guide pin 40 extending up to a desired level above the external side 36 of the ceiling side 34.

In FIG. 8 there is shown a base 54 used for a building consisting of construction elements 6 according to the invention. As will appear from the figure, the base comprises guide pins 40 which extend up to a level over the upwardly-facing side 55 of the base for accommodation in holes cooperating therewith in the underside of the floor sides 32 of construction elements 6 which are placed on top of the base 54, following the same principle as that shown in FIG. 18 and FIG. 19, where it is also seen that in the opening there is placed a dish-shaped, pressure-resistant bearing plate 56. The contact surface 58 of the dish-shaped bearing plate is slightly larger than the area of the free end 46 of the guide pin 40, which enables the placing of the construction element 6 in its correct position with possibilities for compensating tolerances arising with the differences in the size of the contact surface 58 and respectively the area of the free end 46 of the pin.

In FIG. 9 there is seen the base 8 shown in FIG. 8 with construction elements according to the invention placed in a row with the long sides 26 in abutment with each other, so that the ribs 16 on the external sides of the facing sides of the construction elements 6 are pressed against each other, whereby there are formed parallel-extending, vertically-oriented channels 60, which among other things will appear from FIG. 18, FIG. 19, FIG. 20, FIG. 21 and FIG. 22, intended among other things for the placing of reinforcement in connection with the casting of columns for supporting a building consisting of construction elements 6 according to the invention, where in the shown embodiment the insulation material 18 forms the walls in the permanent cladding for casting of columns for the support of the building. The vertically-oriented channels 60 can also be used as guideways for supply cables and leads in association with the building, and for airing of cavities.

As further indicated in FIG. 9, and as will also appear from FIG. 10, between the guide pins 40 there are a number of distance control elements 62 and upstanding inverted U-shaped elements 64, respectively for being able to control the degree to which the respective construction elements 6 are placed correctly at the side of one another, and to be able to roughly guide the individual construction elements 6 into the correct position when these are lifted by means of a crane (not shown) and placed at above-lying levels 44 of the building consisting of construction elements according to the invention.

As will appear from FIG. 10 and FIG. 10A, and also from FIG. 11 and FIG. 12, the distance control element 62 consists of a flat, torsion-resistant piece of material, e.g. steel, the one end of which comprises a fixed anchoring hole 66 for receiving an upstanding guide pin 40' from a first construction element, and where the second end further comprises an elongated hole 68 for receiving a second guide pin 40 on an adjoining construction element 6. Along the elongated hole 68 there is provided a scale 69 for indication of the placing of the guide pin, to help ascertain whether the construction element 6 is positioned correctly and within stated tolerances for same.

The inverted U-shaped element 64 comprises feet 70, 70' in the form of a part 72, 72' bent at an angle at each end, and in the embodiment shown in FIG. 11 the feet also comprise fixed anchoring holes 74 for leading the inverted U-shaped element 64 down over the upstanding guide pins 40 on facing sides of relevant construction elements, which are received in the anchoring holes 74 and led down into contact with the distance control element 62.

FIG. 11 shows a perspective view of the distance control element 62 and respectively a loose, inverted U-shaped element 64, which consists of steel with a flat cross-section. In FIG. 12 there is shown a further embodiment of the distance control element 62 and the inverted U-shaped element 64, where these are joined together so that they form one and the same piece. Here it will be noted that the foot 70 on the inverted U-shaped element 64 now also comprises the elongated hole 68 with the scale 69 for controlling the degree to which the respective construction elements 6 are placed with mutually correct distance.

In FIGS. 13, 13A and 13B there are shown examples of the use of the distance control element 62.

In FIG. 13 there is seen an example of the correct positioning of two adjoining construction elements 6, according to the invention, which is indicated by the guide pin 40 being located in the centre of the elongated hole 68.

In FIG. 13A there is seen an example where the positioning of two adjoining construction elements is not correct, which is indicated by the guide pin 40 being located nearest to the outer side 76 of the elongated hole 68, with the result that a the erection of the construction elements will "gape", i.e. a gap will be formed. A gap between the construction elements in a building consisting of construction elements 6 according to the invention will be unfortunate, namely because there can thereby arise parts where the vertically-oriented channels 60, which are formed by the protruding ribs 16 on facing sides of construction elements 6, will have slot-shaped cracks, which can result in concrete slurry stemming from concrete which is poured into the channels 60 oozing out to other channels, and thus not contribute towards the strengthening/forming of the columns and support beams which are necessary for the stabilising of the building.

In FIG. 13B it is seen that the mounting of two adjoining construction elements is not correct, which is indicated by the guide pin 40 being located nearest to the inner side 78 of the elongated hole 68, with the result that the erection of the construction elements will "pinch" or "taper". But all in all the presence of the distance control element 62 with the scale 69 will constitute an effective tool for ascertaining the degree to which a relevant construction element 6 is correctly positioned.

FIG. 14 shows the building seen in FIG. 8, with all of the construction elements 6 placed at the first level on the base 54.

FIG. 15 shows the same as in FIG. 14, but where the short sides 28 with window openings 30 have been provided with facade elements 82 on the outside of the insulation material 18 of three of the construction elements 6. In the mounting of the façade elements 82, use is made of the same principles regarding the earlier-described guide pins 46', distance element 62' and guide elements 64', as shown in FIG. 15A. The façade elements 82 are thus mounted standing on pins 46' in the base 54, and guided easily into place by means of guide elements 64, and the distance between the facade elements 82 and a relevant construction element 6 is similarly controlled in an easy manner by means of distance control elements 62'.

In FIG. 16 there is shown a detailed vertical cross-section between two consecutive construction elements 6, 6', where the recesses 38 at the corner of the ceiling sides 34, 34', and the cavity above which the distance control element 62 and the U-shaped element 64 extend, is cast with concrete 84. After hardening of the concrete 84, the construction elements 6, 6' are thus ready for the placing of an overlying level of construction elements 6, as will appear from FIG. 17, where the placing of the construction elements 6 at the second level 44 has been started.

In FIG. 18 there is shown a detailed vertical cross-section at the joint between three construction elements 6, 6'6". Note that here the construction element 6" rests on the guide pin 40 standing upright from the underlying construction element 6', which is in contact with the dish-shaped bearing plate 56 in the underside of the construction element 6". There is thereby formed a slot 86 between the external side 36 of the ceiling side 34 of the underlying construction element 6' and the external, downwardly-facing side 88 of the overlying construction element 6". This slot 88 is important for the stability of the construction, inasmuch as this slot, as will appear from FIG. 20, is filled with concrete with the casting of the cavity 90 which is formed when four construction elements 6, 6', 6", 6'" are correctly placed in relation to one another, as will appear from FIG. 19, which shows the section shown in FIG. 18, but where the fourth construction element 6∝" has been mounted, whereby a channel-shaped cavity 60 is formed above the cavity 90 through which it is possible to pour concrete 92 (FIG. 22) for the casting of the cavity 90.

In FIG. 20 it is seen how the poured-in concrete 94 has run into the slot 86 between the downwardly-facing external side 88 of the floor side 32 and the upwardly-facing external side 36 of the underlying construction element 6' in a small area around the dish-shaped bearing plate 56 and the guide pin 40. By the insertion of reinforcement in one or more of the channels 60, with the casting of these channels, columns (not shown) can be established for the support and stabilisation of the building, in step with the establishing of the respective levels by the mounting of further layers of construction elements 6 on top of those which have already been placed. However, it will be understood that out of regard for the maintaining of the strength characteristics of the concrete, and to have the possibility for a visual control regarding the degree to which a cavity has been cast correctly, the casting will be carried out at only one level at a time.

FIG. 21 and FIG. 22 are horizontally-oriented cross-sectional views of a section between two consecutive construction elements according to the invention, where the mounting of façade elements 82 has been carried out.

In FIG. 21 is seen the cavity 90 into which concrete 92 shall be poured for the formation of an internal column 94, the geometry of which is defined by limitation by the insulation material 18. It will be understood that the column 94 is provided with reinforcement rods, but these are not shown here. Depending on the number of levels of which the construction according to the invention is to consist, casting can be carried out of a suitable number of vertically-oriented channels 60 which are formed between the respective construction elements 6, thereby achieving good flexibility regarding the use of these, in that a reinforcement of the constructional conditions can be brought about by casting of the free channels 60, and channels can also be formed for longitudinal and transverse beams for the supporting construction.

In FIG. 22 the cavity 90 is seen cast with concrete (reinforced), whereby a column 94 with a T-shaped cross-section is formed in the cavity.

With a construction element 6 according to the invention, the possibility is provided for the establishing of cheaper constructions of better quality, inasmuch as the individual construction elements 6 in light construction can be delivered to a building site direct from the factory, with finished internal side surfaces and containing the necessary supply conduits and installations, and with external ribs 16 in the insulation material 18 which, when the construction elements are placed side by side with free ends of the ribs in contact with one another, form vertically-oriented channels 60 in which the supporting structure of the building can be cast with reinforced concrete 92.

The method of production also offers the further advantage that both sound-proofing and heat insulation can be effected between the rooms. The degree of insulation can be changed in the element during the production, so that more insulation can be effected in the outer walls where the heat loss is greatest.

Since the production of concrete elements takes place in moulds, there will naturally appear a smooth/finished side, which is formed against the mould, and a rough upper side. Some work will be required on the upper side/rear side afterwards for it to appear smooth and even. With the traditional production of an element, it is considerably more time-consuming to mould installations for e.g. switches into both sides of an element.

By the moulding of two thinner elements, and later placing them together to form one wall, it is only the smooth mould sides that will be seen in the finished construction.

In principle there are moulded two half-elements with insulation on the rear side. In the insulation there shall be cavities/channels which function as cladding for the supporting columns and beams, which are cast in the space after the element is mounted.

Since the element is not required to support the weight of the overlying storeys, but only itself and to serve as cladding, it will weigh considerably less than a solid supporting element.

Electric cables, water and heat supply lines and the like will easily be able to be led through the insulation to installation shafts 60, whereby connection is made easier.

Installation-demanding rooms, such as kitchens and bathrooms, will often be of a size which makes it possible to produce them assembled at the factory with all the elements and installations finished.

With regard to transport, large rooms such as living rooms should be able to be transported to the building site as individual parts (sides), and assembled there before being mounted. The transport will be less exposed to damage since the parts have insulation moulded into their surfaces. The assembly will be able to take place at ground level, after which the construction elements which are now assembled as complete rooms can be mounted with a crane.

The production will be able to be optimised with regard to material quality, precision regarding measurements and angles, alignment, surfaces and pre-mounting of installations. Shoddy workmanship will be able to be detected and rectified before the construction elements 6 leave the factory.

The production entails a great deal of repetition. With careful planning of the individual production and mounting stages, the aspects from the safety point of view will be able to be optimised at each individual step. Security will be able to be built into the processes in accordance with current rules. For example, it will be possible to mould retainers for safety shields and railings into the elements, and also eyes for the securing of safety lines. Railings will thus be able to be mounted on the assembled elements before they are raised into place with a crane.

Many time studies of various construction processes have been carried out. Common to them all is that with the traditionally-produced structures there is wasted a disproportionately great deal of work time with, among other things, reading of drawings, waiting for/moving of material, waiting for other workers, holding meetings and postponements due to the weather. Investigations have shown that that the time wasted is up to 70% of the working hours. Since the material cost and material consumption is more or less the same per unit regardless of the form of production, a considerable saving lies in the optimisation and simplification of the production in the manner which is achieved by the construction element according to the invention. The construction of multi-storey buildings will require considerably fewer erection man-hours at the building site. The new system will mean a general extension of the building season, since the erection work will be less dependent on the weather than is the case with the present methods of construction.

The user will experience an improved quality in several areas. Construction errors will be detected before the building is taken over. In contrast to conventional construction elements, the user will experience a significant reduction in the structure-borne noise. This means that as opposed to singe-wall constructions with massive elements, there will be insulation against noise from neighbours.

The possibility of the degree of insulation being tailor-made to current standards will mean a considerable reduction in the consumption of heat to the benefit of the environment. By incorporating the latest techniques for the recovery of heat, and configuring parts of the façade and the roof for mounting of solar heating systems and solar cells, the need for supplied energy can be significantly reduced.

Building and construction companies are influenced by great fluctuations in market conditions, with subsequent periodic unemployment. Market sensitivity will be able to be greatly reduced by drawing up a building system with construction elements 6 as disclosed in the above.

Since the production and the mounting of elements differs greatly from the present methods, it must be expected that all development and production workers shall be specifically trained. Both through external courses within security, such as crane and truck drivers and scaffold erectors, and internal training in the actual production.

The production process involves that the elements are moved with cranes/trucks, and that there are not many heavy manual lifting tasks. Therefore, there will be good possibilities for an equal division of male/female employment in the overall concern. This also involves a greater basis for the recruiting of both skilled and unskilled personnel.

All in all, with the construction element according to the invention, the possibility is presented of providing better, cheaper and more environmentally-defensible building operations.

| | |
|---|---|
| 2 | frame of reinforced concrete |
| 4 | concrete side |
| 6 | construction element according to the invention |
| 8 | light concrete |
| 10 | space defined by the frame 2 |
| 12 | internal side of concrete side |
| 14 | external side of concrete side |
| 16 | ribs on external side |
| 18 | insulating material |
| 19 | projections on the insulating material 18 |
| 20 | side of the insulating material 18 facing towards the light concrete 8 |
| 21 | reinforcement rods |
| 22 | corrugations |
| 24 | smaller ribs |
| 25 | cruciform slot in projection 19 |
| 26 | long sides |
| 27 | tops of cruciform slot 25 in projection 19 |
| 28 | short sides |
| 29 | chamfers on the tops 27 |
| 30 | window opening |

-continued

| | |
|---|---|
| 32 | floor side |
| 34 | ceiling side |
| 36 | external side of ceiling side |
| 38 | recesses at corners of the ceiling side 34 |
| 40 | upright-standing guide pin |
| 42 | bush moulded into ceiling side |
| 44 | second level of building |
| 46 | free end of the guide pin 40 |
| 48 | part of the side of the guide pin facing the bush 42 |
| 50 | counter-nut |
| 52 | thread in bush 42 |
| 54 | base for building |
| 55 | upper side of base 54 |
| 56 | dish-shaped bearing plate in downwardly-facing side of the floor side 32 |
| 58 | contact surface of bearing plate |
| 60 | vertically-oriented channels between two consecutive construction elements 6 |
| 62 | distance control element |
| 64 | inverted U-shaped element |
| 66 | fixed anchoring hole in distance control element |
| 68 | elongated hole in distance control element |
| 69 | scale along edge of elongated hole |
| 70 | feet on U-shaped element |
| 72 | parts of 64 bent at an angle to form feet 70 |
| 74 | fixed anchoring hole in U-shaped element 63 |
| 76 | outer side of elongated hole 68 |
| 78 | inner side of elongated hole 68 |
| 80 | first level of building |
| 82 | facade elements |
| 84 | concrete in recesses 38 |
| 86 | slot between ceiling side and floor side |
| 88 | downwardly-facing side of the floor side 32 |
| 90 | cavity between construction elements for casting |
| 92 | concrete poured into the cavity 90 |
| 94 | column |

The invention claimed is:

1. A prefabricated, self-supporting construction element (6) for use in the construction of a multi-storey building where a plurality of such construction elements are assembled alongside and on top of one another, wherein:

the construction element (6) has a plurality of sides comprising a substantially rectangular floor side (32), at least two substantially parallel wall sides (26) standing upright from said floor side (32), and a ceiling side (34) above the wall sides (26);

each of said sides has an internal surface (12) and an external surface (14);

each of said internal surfaces (12) is a finished surface;

each of said external surfaces (14) is profiled with protruding ribs (16) such that adjacent external surfaces (14) of adjacent construction elements (6) form, in use, a plurality of horizontally-oriented and vertically-oriented channels (60) for in-situ casting of a flowing, hardening material for the formation of a supporting structure in the form of columns (94) and beams for supporting a plurality of construction elements (6) on top of one another and for the leading of supply lines, pipes and cables to the building;

said external surfaces (14) comprise insulating material (18) which, when brought together with corresponding external surfaces (14) of adjacent construction elements (6), creates a stable element that forms a permanent insulating cladding for the subsequently in-situ cast supporting structure; and the protruding ribs (16) on said external surfaces (14) are formed in the insulating material (18).

2. A construction element (6) according to claim 1, in which the side of the insulating material (18) is configured with holes, slots (24) or outwardly-facing fields which can be pressed into unhardened material of an inner wall for absorbing irregularities and height differences, and ensuring of parallelism and distance between internal side surfaces (12) and external side surfaces (14) of the construction element (6), and in that the side of the insulating material (18) facing towards the outer side of the construction element (6) is configured with profiles which make possible the mounting of installations in both the vertical and the horizontal plane and also an inclined plane, at the same time that the ribs (16) form insulated mould channels (60) for the supporting structure (94).

3. A construction element (6) according to claim 1, in which the insulating material (18) comprises holes/recesses for the mounting of clips for securing reinforcement during casting.

4. A construction element (6) according to claim 1, in which the insulating material (18) comprises moulded holes/recesses for receiving and securing reinforcement for strengthening of concrete which is introduced into the or those channels (60) which are formed by said relevant opposing ribs (16) in combination.

5. A construction element (6) according to claim 1, in which the insulation material (18) comprises projections (19) with end surfaces which comprise a cruciform slot (25) for receiving reinforcement rods (21), which are pressed into said slot.

6. A construction element (6) according to claim 1, in which the ceiling side (34) comprises a number of recesses (38) comprising moulded-in bushes (42) for the insertion of a number of adjustable and lockable guide pins (40) extending vertically from the external surface (14) of the ceiling side (34), said guide pins cooperating with recesses comprising bearing plates (56) on the external, downwardly-facing surface (88) of the floor side (32) of the construction element.

7. A construction element (6) according to claim 6, in which over and between the upright guide pins (40) on the sides of adjoining construction elements (6, 6') facing one another there is a distance piece (62) comprising a fixed anchoring hole (66) with a circular opening for receiving a first guide pin (40'), and an elongated hole (68) with a scale (69) along at least one straight side for receiving a second guide pin (40) for control of tolerances in the erection of the construction elements.

8. A construction (6) according to claim 7, in which between the upright guide pins (40) over the distance piece (62) there is a bow-shaped, upwardly-directed guide element (64).

9. A construction element (6) according to claim 8, in which the bow-shaped, upwardly-directed guide element (64) is in the form of an inverted U-shaped profile, the respective ends of which comprise a mutual approximately parallel extent, said parallel extents each comprising a bluntly extending part (72, 72') bent at an angle away from the centre transverse plane of the U-shaped profile, where each of the bluntly extending parts comprises a circular cut-out/hole (74).

10. A construction element (6) according to claim 9, in which the bow-shaped upwardly-directed guide element (64) and the distance piece (62) are integrated, where the one of the bluntly-extending parts comprises a circular cut-out/hole (74'), and the other of the bluntly-extending parts comprises an elongated or circular cut-out (74'), which is placed over the elongated cut-out/hole (68) in the distance piece (62).

11. A construction element (6) according to claim 1, in which the protruding ribs (16) have end surfaces with integrated extending strips of rubber.

12. A construction element (6) according to claim 1, in which the wall, floor and ceiling sides (26, 28, 32, 34) are built up as moulded frame constructions with beams (2) along the outer edges to define a frame (10) in which a light-weight concrete is cast.

13. A multi-storey building assembled from a plurality of construction elements according to claim 1, assembled alongside and on top of one another, with said flowing, hardening material cast in-situ in said channels (60) to form said columns (94) and beams.

14. A multi-storey building according to claim 13, wherein said flowing, hardening material comprises concrete.

15. A method of constructing a multi-storey building, comprising the steps of prefabricating a plurality of self-supporting construction elements (6) and assembling said construction elements alongside and on top of one another, wherein:

each construction element (6) has a plurality of sides comprising a substantially rectangular floor side (32), at least two substantially parallel wall sides (26) standing upright from said floor side (32), and a ceiling side (34) above the wall sides (26);

each of said sides has an internal surface (12) and an external surface (14);

each of said internal surfaces (12) is a finished surface;

each of said external surfaces (14) is profiled with protruding ribs (16) such that adjacent external surfaces (14) of adjacent construction elements (6) form a plurality of horizontally-oriented and vertically-oriented channels (60) in which a flowing, hardening material is cast in-situ to form a supporting structure in the form of columns (94) and beams for supporting said construction elements (6) on top of one another and for the leading of supply lines, pipes and cables to the building;

said external surfaces (14) comprise insulating material (18) which, together with corresponding external surfaces (14) of adjacent construction elements (6), creates a stable element that forms a permanent insulating cladding for the in-situ cast supporting structure; and the protruding ribs (16) on said external surfaces (14) are formed in the insulating material (18).

16. A method according to claim 15, wherein said flowing, hardening material comprises concrete.

17. A method according to claim 15 wherein, in a first step, said sides of said construction elements are fabricated, in a second step, said sides are assembled to form said construction elements and, in a third step, said construction elements are assembled alongside and on top of one another, said first step being carried out in a first, factory location and said third step being carried out in a third, construction location remote from said first location.

18. A method according to claim 17, wherein said second step is carried out at said first location.

19. A method according to claim 17, wherein said second step is carried out at said third location.

* * * * *